US009610792B2

(12) United States Patent
Yoshikawa et al.

(10) Patent No.: US 9,610,792 B2
(45) Date of Patent: Apr. 4, 2017

(54) RECORDING APPARATUS

(71) Applicant: SEIKO EPSON CORPORATION, Tokyo (JP)

(72) Inventors: Shinichiro Yoshikawa, Matsumoto (JP); Hiroki Chino, Matsumoto (JP); Yuichi Segawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/053,385

(22) Filed: Feb. 25, 2016

(65) Prior Publication Data

US 2016/0274529 A1 Sep. 22, 2016

(30) Foreign Application Priority Data

Mar. 20, 2015 (JP) ..... 2015-057202

(51) Int. Cl.

| | |
|---|---|
| ***B41J 29/02*** | (2006.01) |
| ***B41J 29/13*** | (2006.01) |
| ***B41J 25/34*** | (2006.01) |
| ***G03G 21/16*** | (2006.01) |

(52) U.S. Cl.

CPC ..... *B41J 29/02* (2013.01); *B41J 25/34* (2013.01); *B41J 29/13* (2013.01); *G03G 21/1652* (2013.01)

(58) Field of Classification Search

CPC ..... G03G 21/1609; B41J 29/02

See application file for complete search history.

(56) References Cited

U.S. PATENT DOCUMENTS

| | | | | |
|---|---|---|---|---|
| 2002/0126180 | A1* | 9/2002 | Hiramatsu | B41J 2/17 347/58 |
| 2004/0056926 | A1* | 3/2004 | Samoto | B41J 29/02 347/50 |
| 2009/0141071 | A1 | 6/2009 | Kubo et al. | |
| 2014/0192114 | A1* | 7/2014 | Ito | B41J 19/005 347/37 |

FOREIGN PATENT DOCUMENTS

| | | |
|---|---|---|
| JP | 2008-080614 A | 4/2008 |
| JP | 2009-132036 A | 6/2009 |

* cited by examiner

*Primary Examiner* — Alessandro Amari
*Assistant Examiner* — Roger W Pisha, II
(74) *Attorney, Agent, or Firm* — Workman Nydegger

(57) ABSTRACT

There is provided a recording apparatus including: a recording section that performs recording on a recording medium; a cable relay section that is provided between a first area, in which the recording section is arranged, and a second area in which a control section for control is arranged, and that relays cables; a first cable that is configured to extend from the recording section and is connected to the cable relay section on a side of the first area; and a second cable that is configured to extend from the control section and is connected to the cable relay section on a side of the second area.

8 Claims, 20 Drawing Sheets

RECORDING APPARATUS

BACKGROUND

1. Technical Field

The present invention relates to a recording apparatus which performs recording on a recording medium.

2. Related Art

In an ink jet printer, which is an example of a recording apparatus, there is a case in which the control section and the recording head of the printer are connected to each other through a flexible flat cable as disclosed in JP-A-2008-80614.

In addition, the ink jet printer includes a serial type and a line head type. In a line head type printer, the recording head is configured such that ink discharge nozzles are arranged to cover the whole area of a paper width, an ink accommodation section is connected to the recording head through an ink tube, and thus ink is supplied from the ink accommodation section to the recording head. That is, a state in which a plurality of flexible flat cables and a plurality of ink tubes extend from the recording head.

There are cases in which the line head type ink jet printer is easily increased in size and the maintenance, exchange or the like is performed on a recording head by a serviceman for a printer installation spot. At this time, there is a problem in that the removal of the flexible flat cables is complicated, it requires extra effort to perform the work, and thus long time work is forced.

More specifically, for example, all of the flexible flat cables which extend from the recording head are connected to a control substrate. However, the control substrate is generally provided in the secluded location of the device, and thus accessibility is not good. Accordingly, when it is necessary to exchange the flexible flat cables for some reasons, for example, when a contact part, which is connected to the recording head, is deteriorated or damaged, it is necessary for the serviceman to access the control substrate and to exchange the flexible flat cables, with the result that it requires extra effort to perform the work, and thus long time work is forced. In addition, as disclosed in JP-A-2009-132036, all of the ink tubes are connected to a cartridge holder which is separated from the recording head, and thus there is the same problem as in the work which is performed on the flexible flat cable when the ink tubes are exchanged.

SUMMARY

An advantage of some aspects of the invention is to improve the workability of the maintenance and exchange of a recording head, thereby reducing work time.

According to a first aspect of the invention, there is provided a recording apparatus including: a recording section that performs recording on a recording medium; a cable relay section that is provided between a first area, in which the recording section is arranged, and a second area in which a control section for control is arranged, and that relays cables; a first cable that is configured to extend from the recording section and is connected to the cable relay section on a side of the first area; and a second cable that is configured to extend from the control section and is connected to the cable relay section on a side of the second area.

According to the aspect, the cable relay section that relays cables is provided between the first area, in which the recording section that performs recording on the recording medium is arranged, and the second area in which the control section for control is arranged. Further, the first cable that extends from the recording section and the second cable that extends from the control section are connected to the cable relay section. Therefore, when a work of maintaining or exchanging the recording section is performed, it is not necessary to access the control section and access to the cable relay section is sufficient. Therefore, workability is excellent when the work of maintaining or exchanging the recording section is performed, and it is possible to reduce work time.

In the recording apparatus according to a second aspect of the invention, the cable relay section may be provided in a frame which performs division into the first area and the second area.

According to the aspect, it is possible to acquire the same advantage as in the first aspect according to the invention.

In the recording apparatus according to a third aspect of the invention, an end of the cable relay section on the side of the first area may be located on the side of the second area rather than an end of the frame on the side of the first area.

According to the aspect, the end of the cable relay section on the side of the first area is located on the side of the second area rather than the end of the frame on the side of the first area. Therefore, it is possible to reduce the amount of protrusion of the cable relay section on the side of the first area or it is possible to prevent protrusion. Accordingly, when the recording section is attached or detached, it is possible to suppress the recording section from being caught by the cable relay section, and thus a work of attaching or detaching the recording section becomes easier.

In the recording apparatus according to a fourth aspect of the invention, the frame may be provided with a cable passing section that causes the first area and the second area to communicate with other and passes the cable. A third cable, which has a signal standard different from those of the first cable and the second cable, may directly connect the recording section to the control section through the cable passing section, and the third cable may be configured to be detachable from the recording section.

According to the aspect, the third cable, which has the signal standard different from those of the first cable and the second cable, directly connects the recording section to the control section through the cable passing section, and thus it is possible to perform excellent information transmission, in which signal deterioration is suppressed, by using the third cable. In addition, the third cable is configured to be capable of being detached from the recording section, and thus it is easy to reuse the third cable even when the recording section is exchanged.

In the recording apparatus according to a fifth aspect of the invention, the first cable and the third cable may be arranged along an upper surface of the recording section and are configured to extend on an outside of the recording section, and the first cable on the upper surface of the recording section may be arranged on the upper side of the third cable.

According to the aspect, on the upper surface of the recording section, the first cable is wired on the upper side of the third cable, and thus the third cable does not disturb a work performed when the first cable is retracted into the cable relay section, thereby increasing workability.

In the recording apparatus according to a sixth aspect of the invention, a recording apparatus may further include a tube that supplies liquid from a liquid accommodation section, which accommodates the liquid, to the recording section, and the tube may be arranged on an upper side of the first cable and is configured to extend to the outside of the recording section.

According to the aspect, the tube that supplies liquid from the liquid accommodation section, which accommodates the liquid, to the recording section, is included. The tube is arranged on the upper side of the first cable and is configured to extend to the outside of the recording section, and thus the recording section-side cable does not disturb a work of removing the tube, thereby increasing workability.

According to a seventh aspect of the invention, there is provided a recording apparatus including: a detachable recording section that performs recording on a recording medium; a tube relay section that is provided between a first area, in which the recording section is arranged, and a second area in which a control section for control is arranged, and that is configured to relay a tube; a first tube that is provided on a side of the first area and is connected to the tube relay section on the side of the first area; and a second tube that is provided on a side of the second area and is connected to the tube relay section on the side of the second area.

According to the aspect, the tube relay section that relays the tube between the first area, in which the recording section for performing recording on the recording medium is arranged, and the second area, in which the control section for control is arranged, is provided. Further, the first tube, which is provided on the side of the first area, and the second tube, which is provided on the side of the second area, are connected to the tube relay section. Therefore, when the work of maintaining or exchanging the recording section is performed, it is not necessary to access the liquid accommodation section which is provided in the device, and access to the tube relay section is sufficient. Therefore, workability, which is acquired when the work of maintaining or exchanging the recording section is performed, is excellent, and thus it is possible to reduce work time.

According to an eighth aspect of the invention, in the seventh aspect, wherein the tube relay section may be provided in a frame which performs division into the first area and the second area.

According to the aspect, it is possible to acquire the same advantage as in the seventh aspect according to the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Also, the same reference symbols are attached to the same components in the respective embodiments, the description thereof is performed in an initial embodiment, and the description of the components will not be repeated in the subsequent embodiments.

Figure 1:
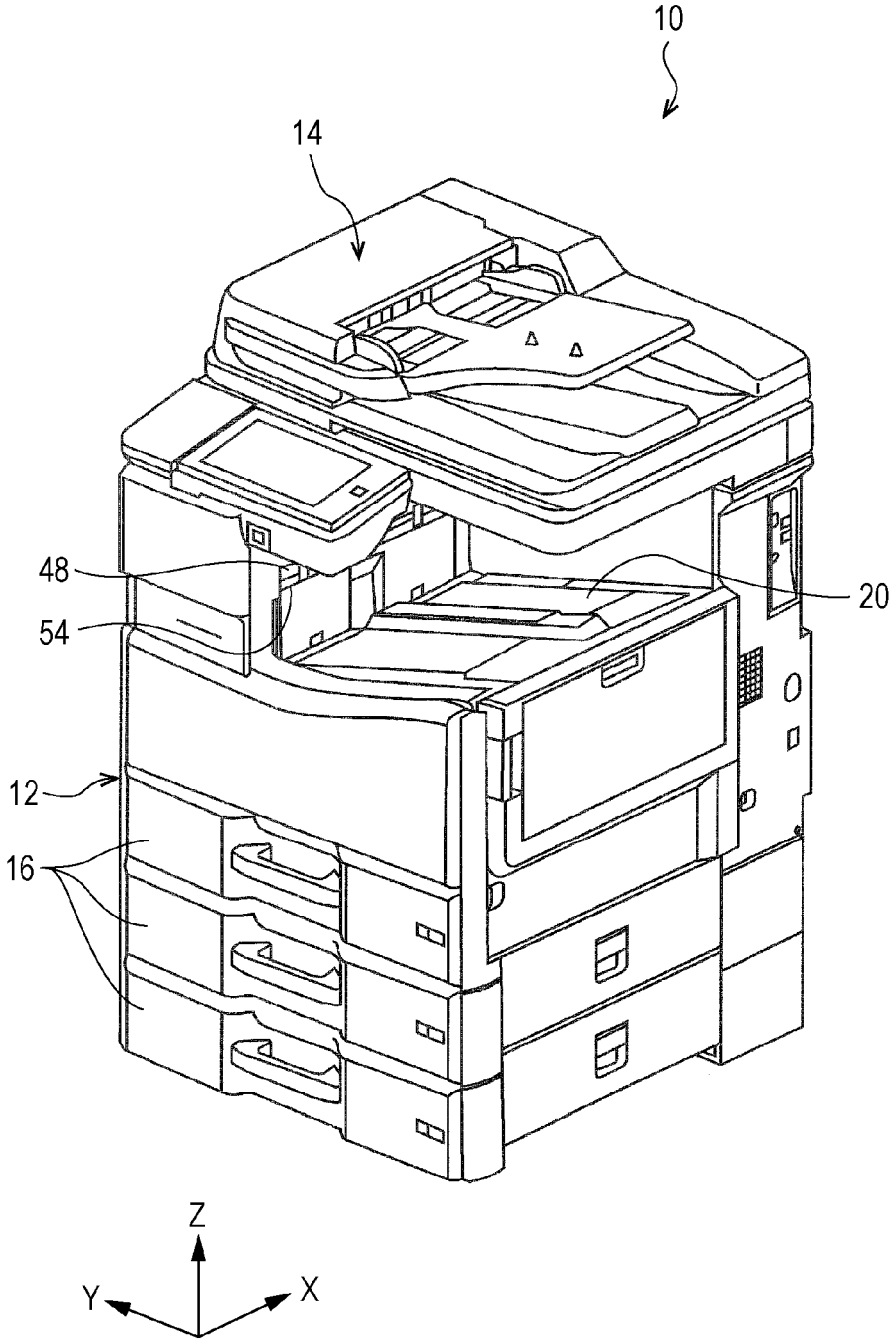
FIG. 1 is a perspective view illustrating the external appearance of a printer according to the invention.
Figure 2:
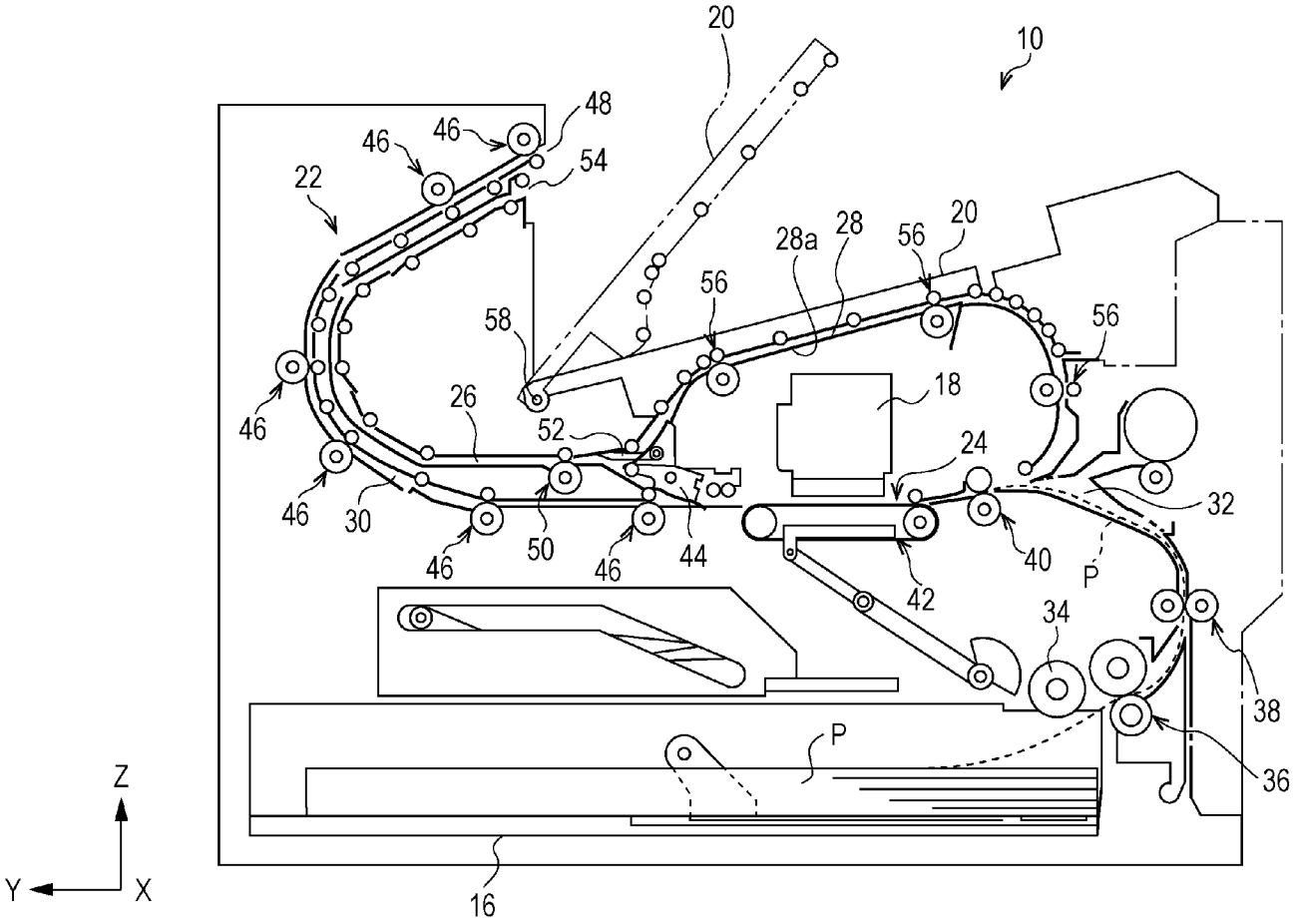
FIG. 2 is a side sectional view illustrating a medium transport path in the printer according to the invention.
Figure 3:
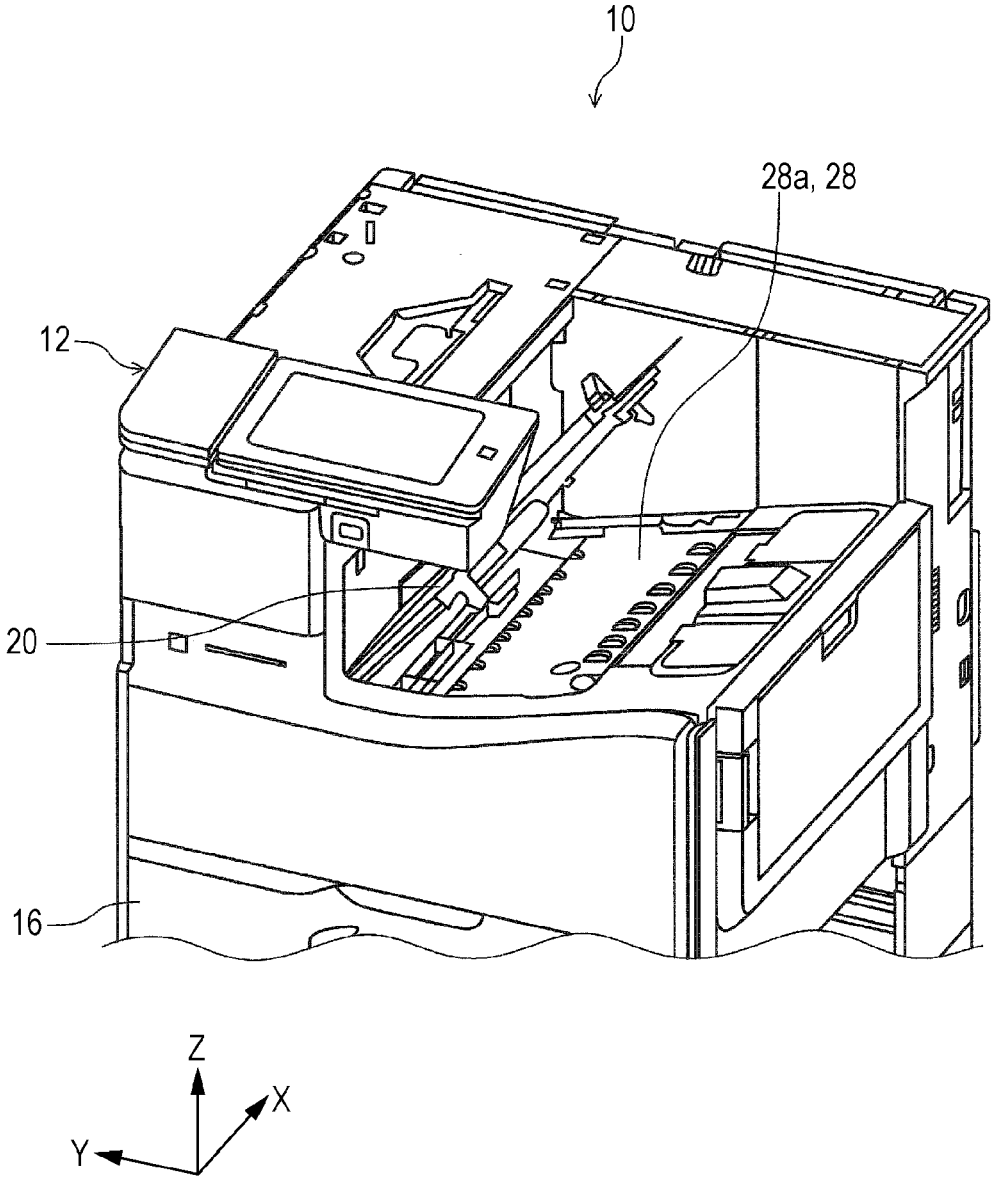
FIG. 3 is a perspective view illustrating a state of being open for the device main body of a medium receiving tray.
Figure 4:
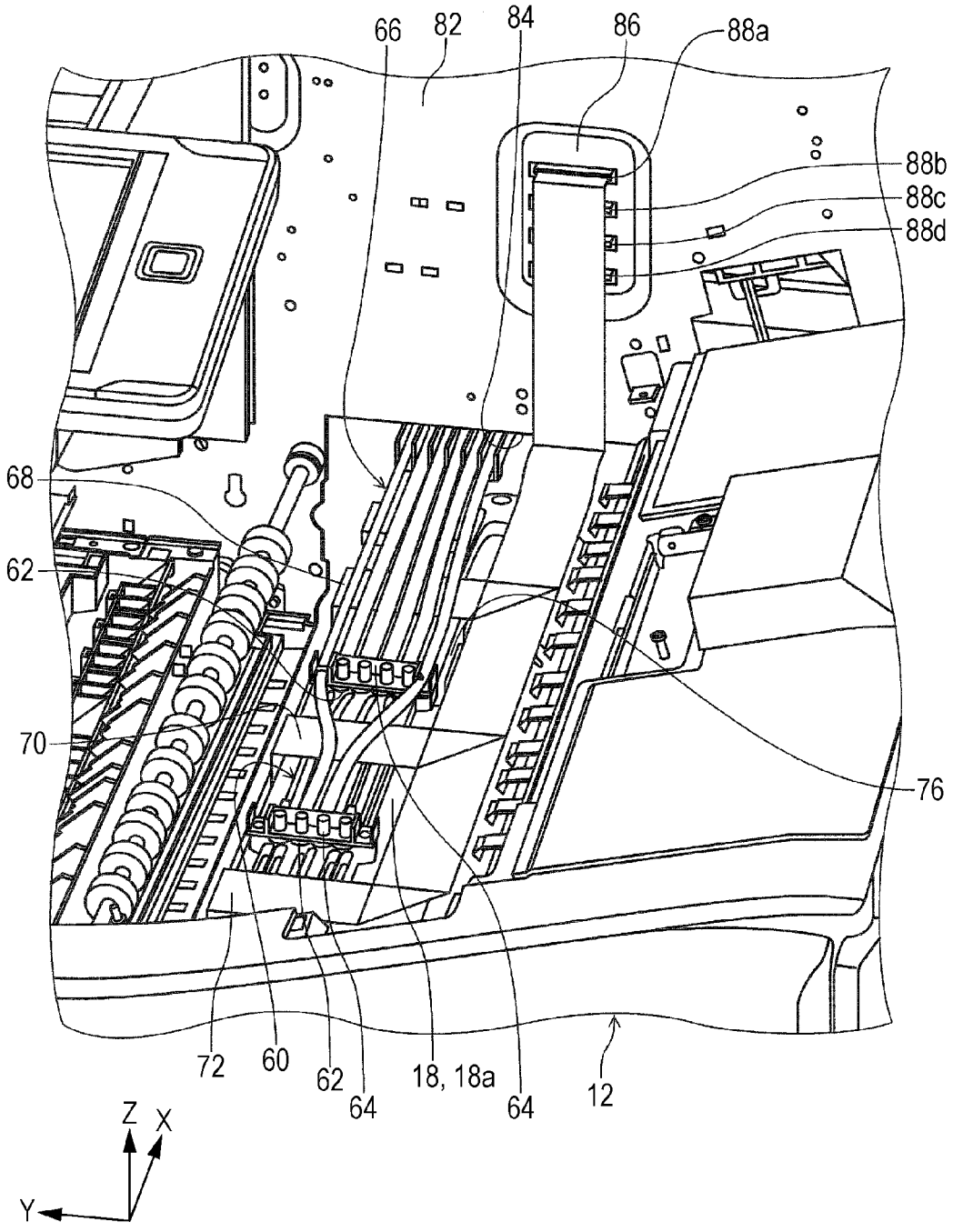
FIG. 4 is a perspective view illustrating the handling of ink tubes and flat cables in the upper part of a line head.
Figure 5:
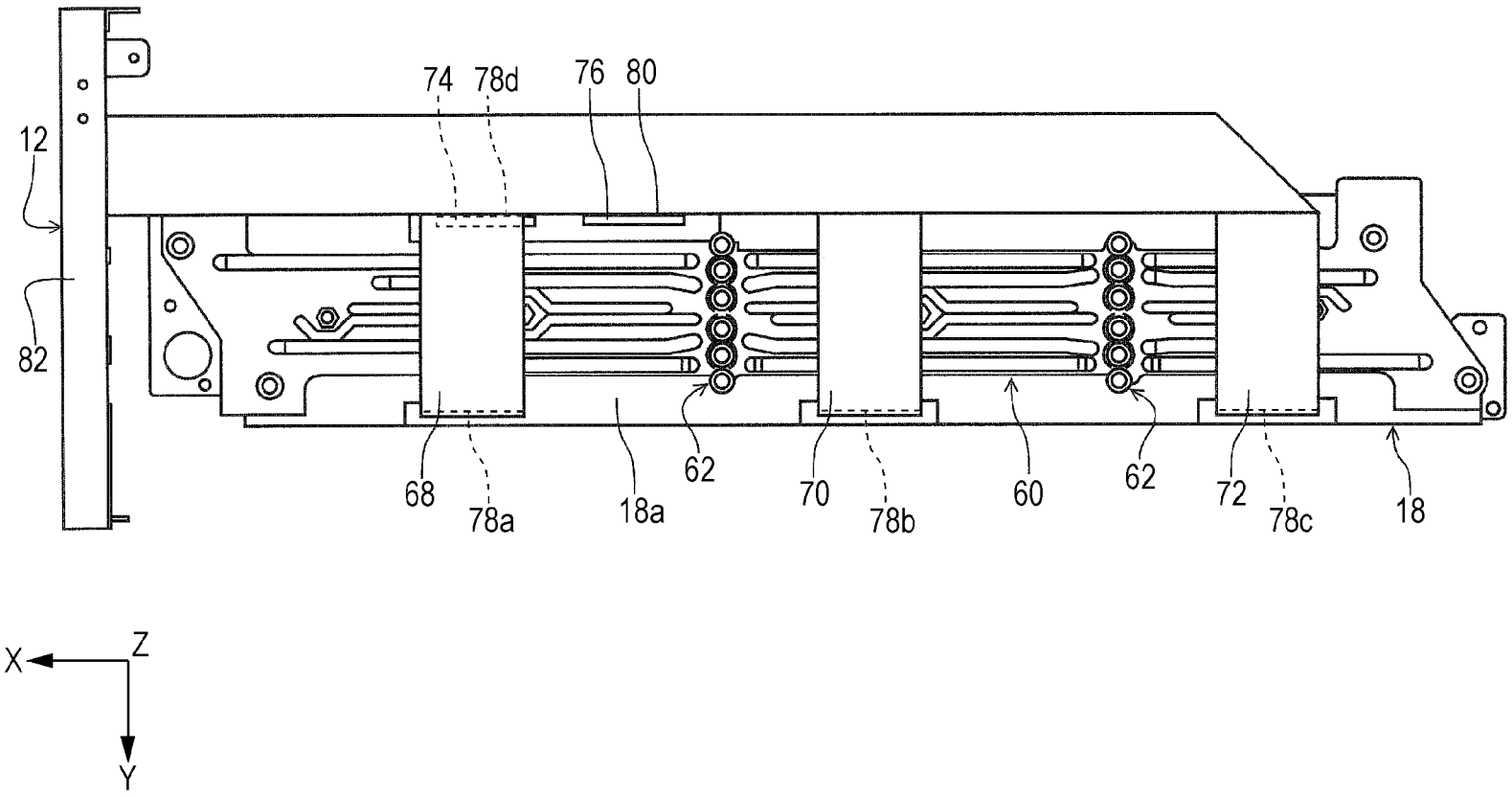
FIG. 5 is a plan view illustrating the handling of the ink tubes and the flat cables in the upper part of the line head.
Figure 6A:
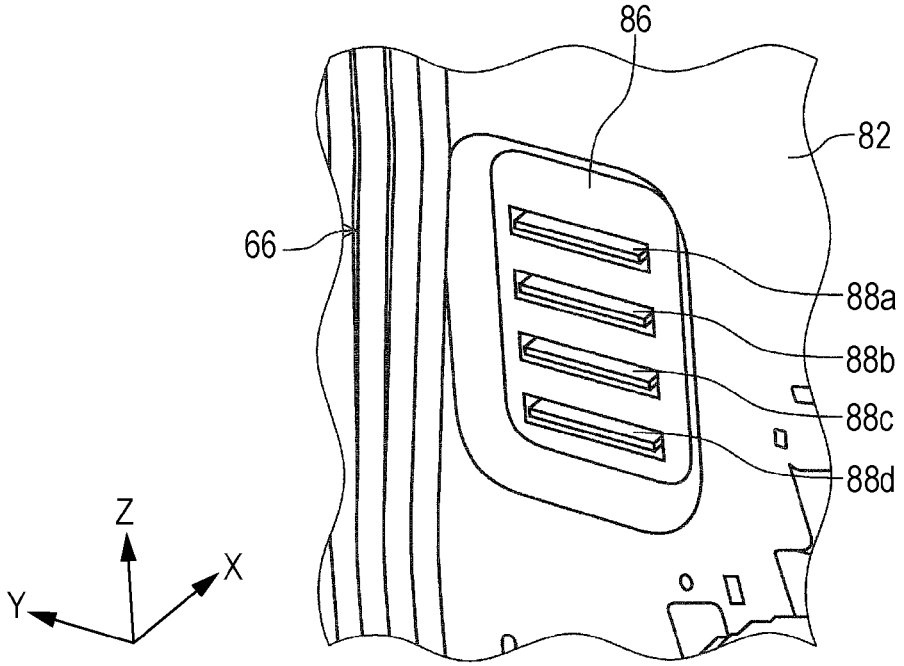
FIG. 6A is a perspective view illustrating a cable relay section on a recording section side.
Figure 6B:
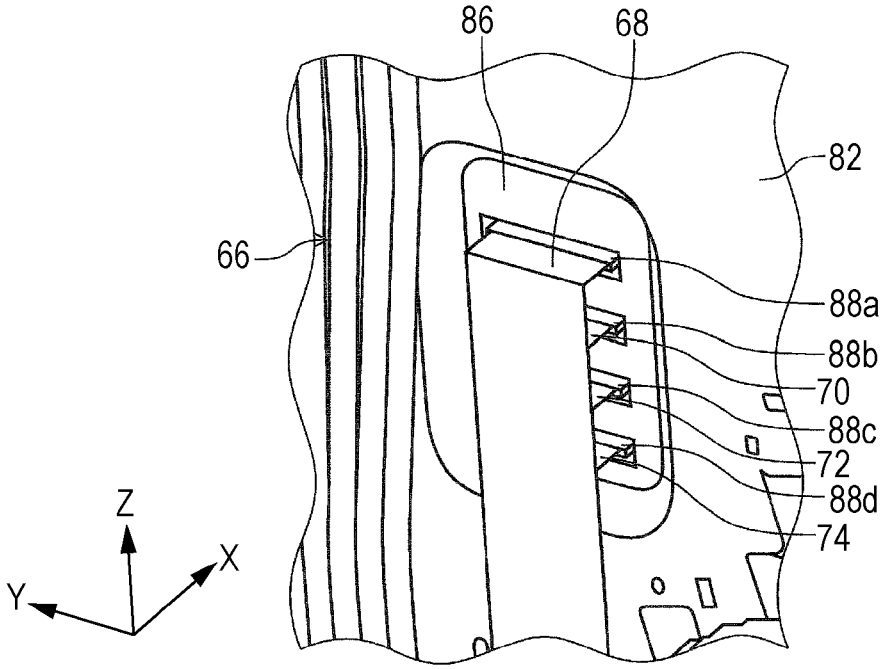
FIG. 6B is a perspective view illustrating a state in which the flat cables from the line head are attached to the cable relay section on the recording section side.

FIG. 1 is a perspective view illustrating the external appearance of a printer according to the invention, FIG. 2 is a side sectional view illustrating a medium transport path in the printer according to the invention, FIG. 3 is a perspective view illustrating a state of being open for the device main body of a medium receiving tray, FIG. 4 is a perspective view illustrating the handling of ink tubes and flat cables in the upper part of a line head, FIG. 5 is a plan view illustrating the handling of the ink tubes and the flat cables in the upper part of the line head, FIG. 6A is a perspective view illustrating a cable relay section on a recording section side, and FIG. 6B is a perspective view illustrating a state in which the flat cables from the line head are attached to the cable relay section on the recording section side.

Figure 7:
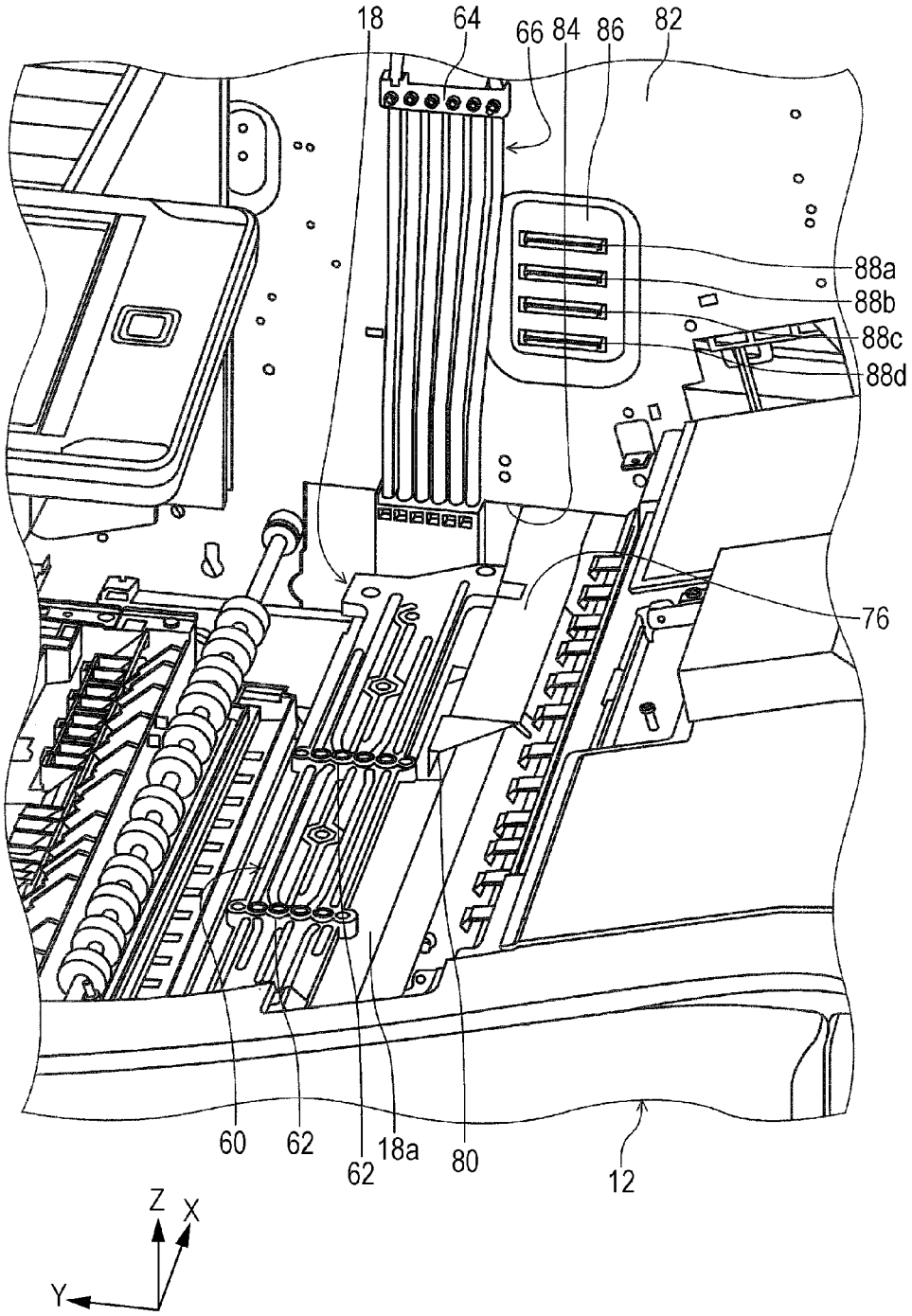
FIG. 7 is a perspective view illustrating a state in which only a high-speed data transmission cable is connected to the line head.
Figure 8A:
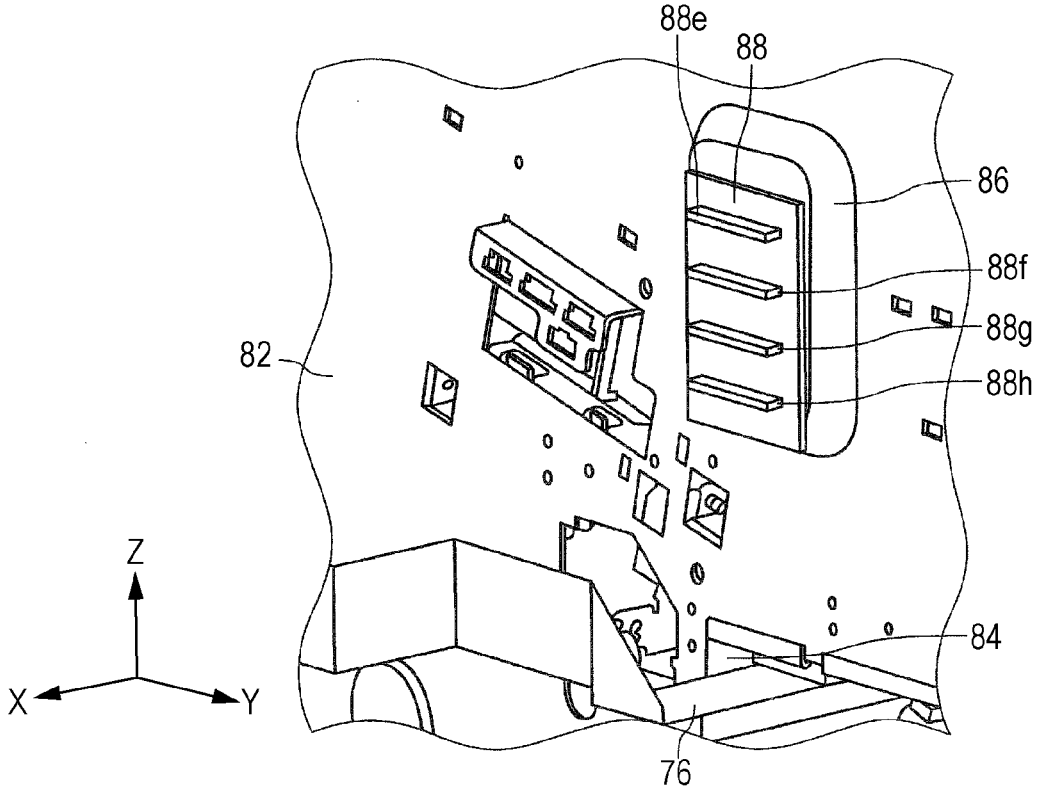
FIG. 8A is a perspective view illustrating the cable relay section on a control section side.
Figure 8B:
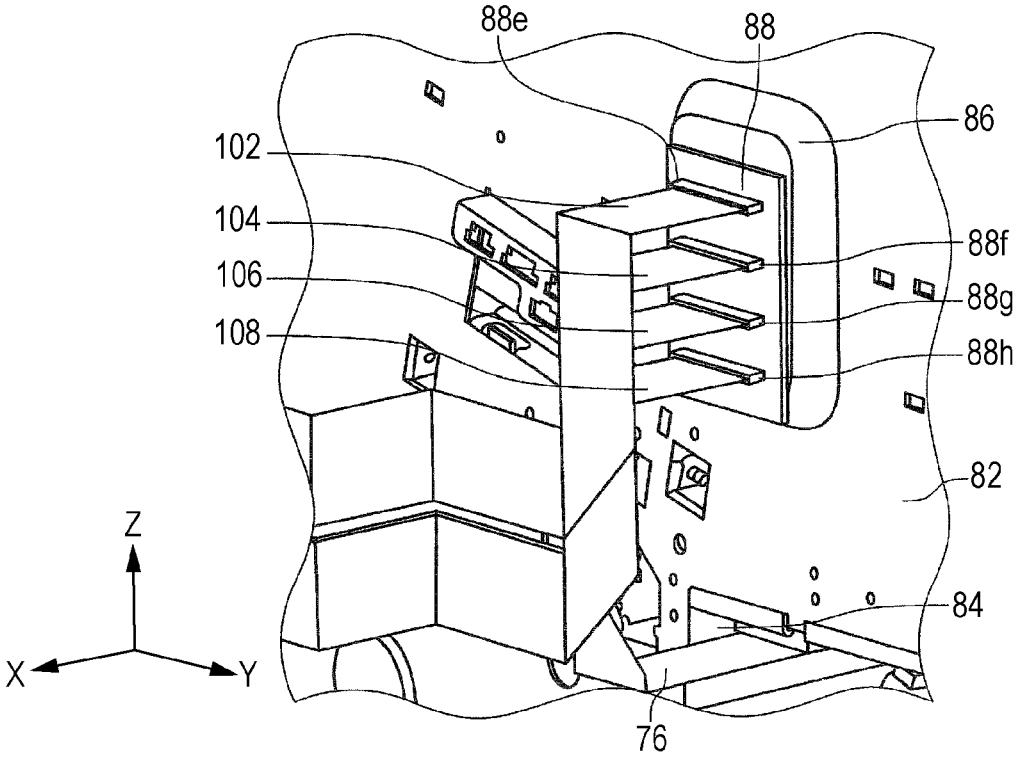
FIG. 8B is a perspective view illustrating a state in which the flat cables from the control section are attached to the cable relay section on the control section side.
Figure 9:
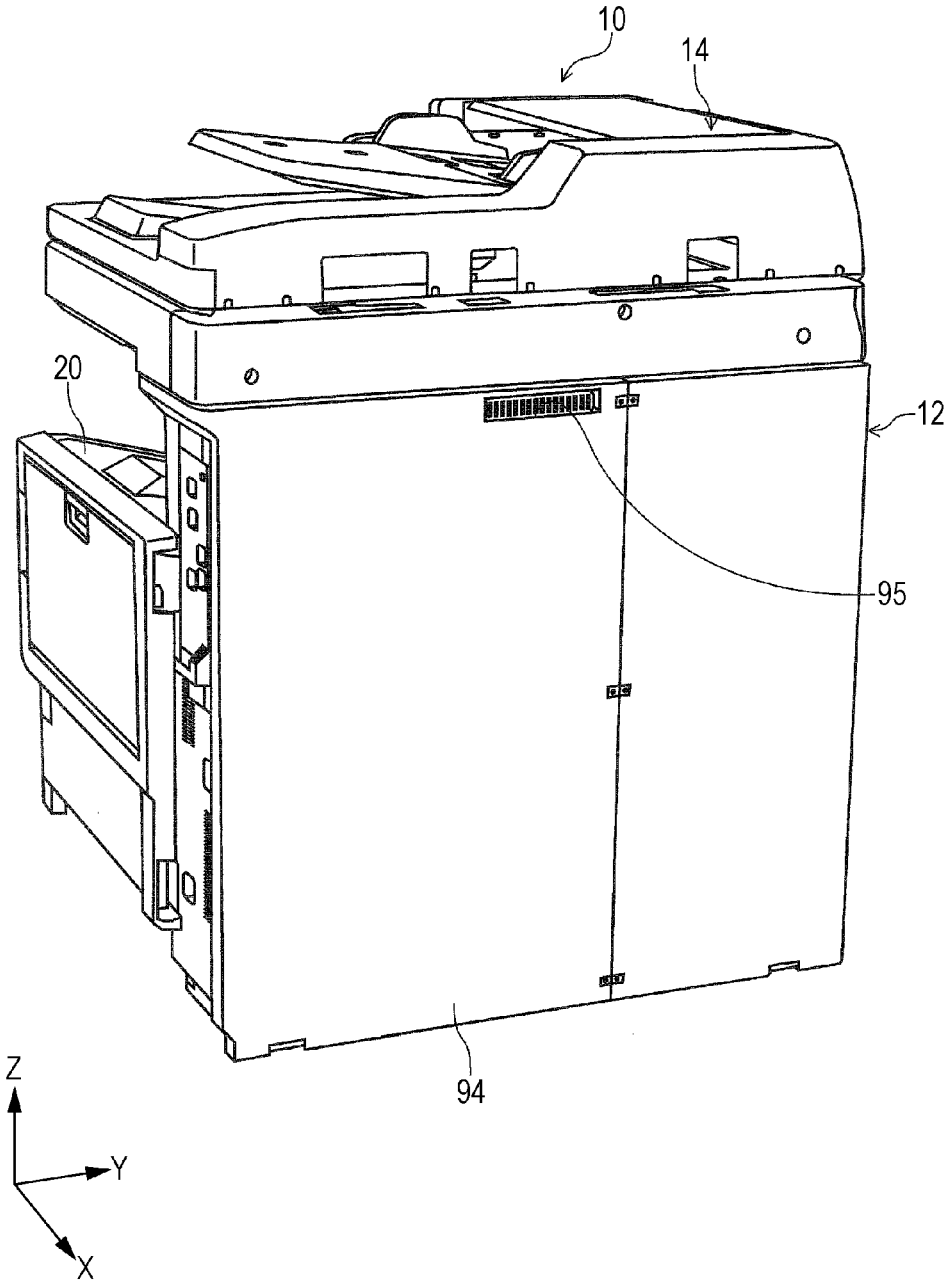
FIG. 9 is a perspective view illustrating the back side of the printer according to the invention.
Figure 10:
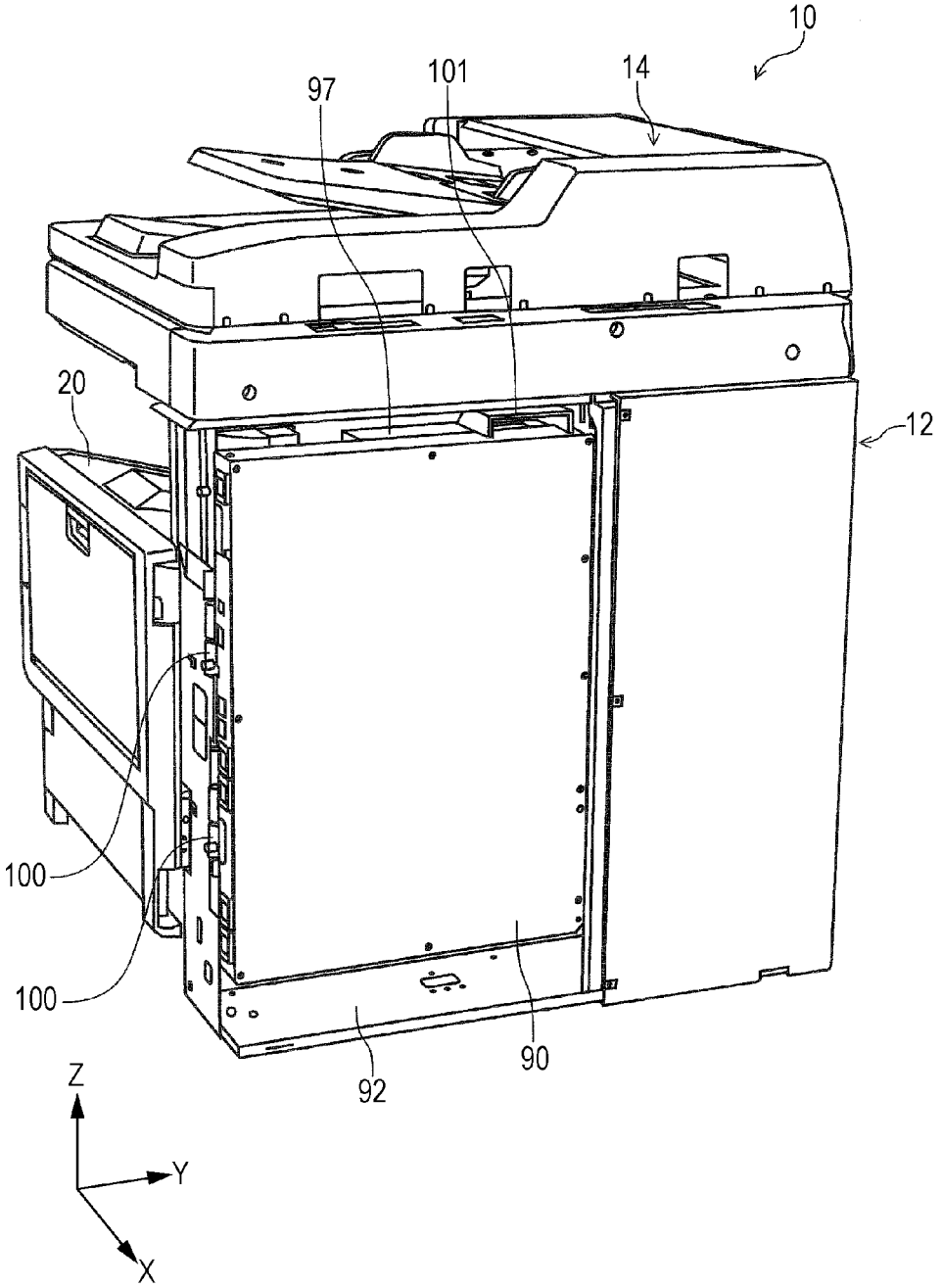
FIG. 10 is a perspective view illustrating the control section in a state in which an exterior cover is removed on the back side of the printer according to the invention.
Figure 11:
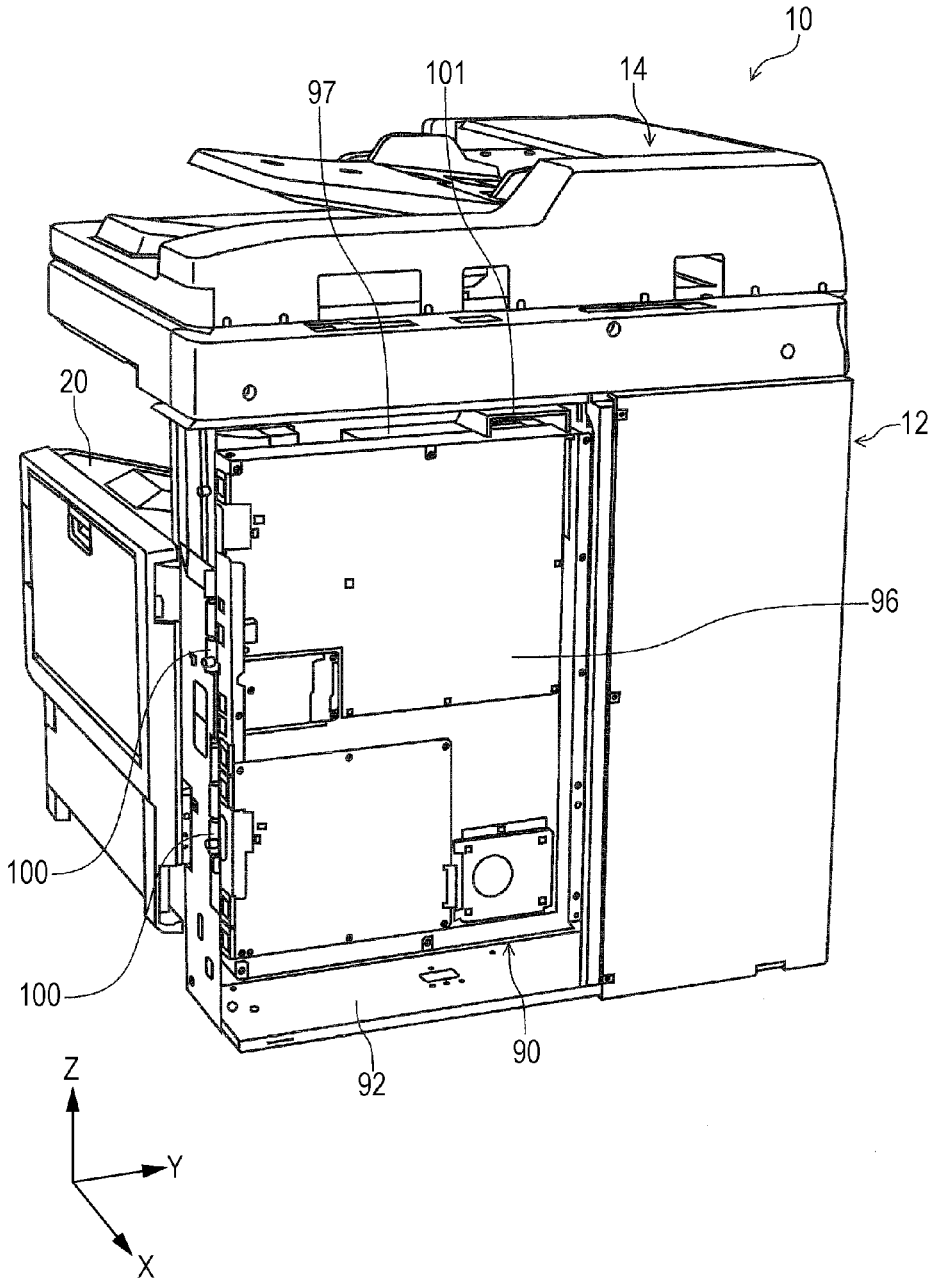
FIG. 11 is a perspective view illustrating a main control substrate in the control section on the back side of the printer.
Figure 12:
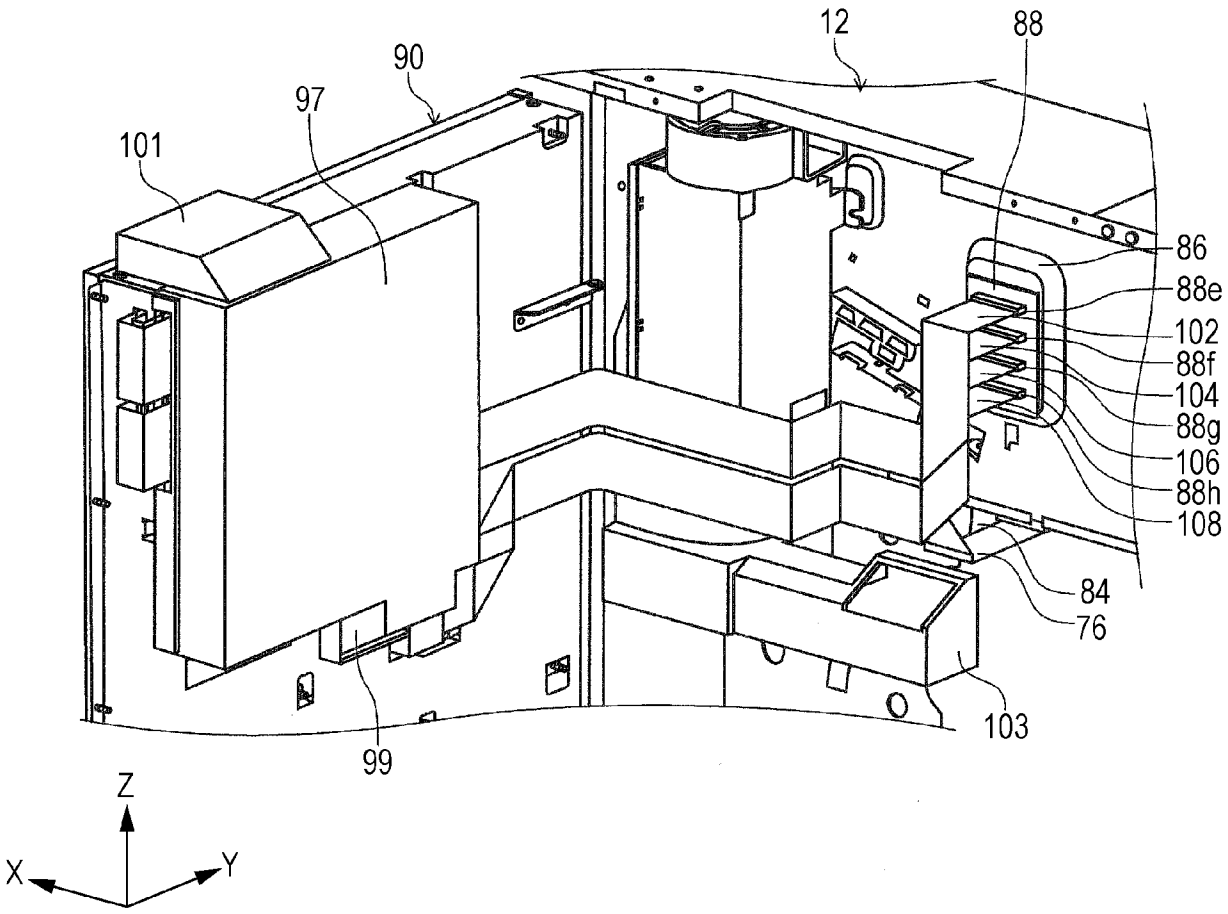
FIG. 12 is a view illustrating a state, in which the control section rotary moves for the device main body, on the back side of the printer.
Figure 13:
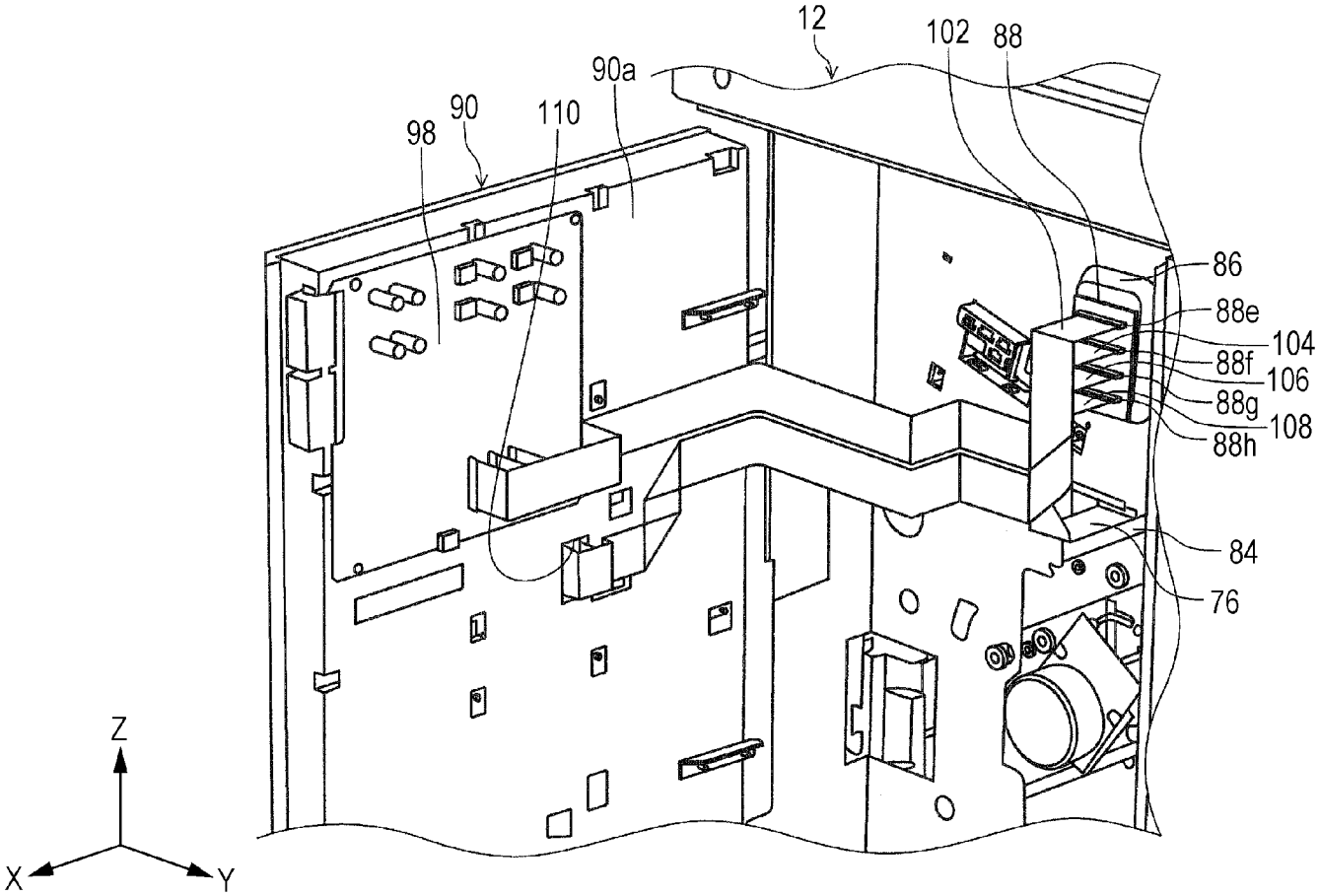
FIG. 13 is a perspective view illustrating the handling of the flat cables which extend from the cable relay section in a state in which the control section rotary moves for the device main body.

FIG. 7 is a perspective view illustrating a state in which only a high-speed data transmission cable is connected to the line head, FIG. 8A is a perspective view illustrating the cable relay section on a control section side, FIG. 8B is a perspective view illustrating a state in which the flat cables from the control section are attached to the cable relay section on the control section side, FIG. 9 is a perspective view illustrating the back side of the printer according to the invention, FIG. 10 is a perspective view illustrating the control section in a state in which an exterior cover is removed on the back side of the printer according to the invention, FIG. 11 is a perspective view illustrating a main control substrate in the control section on the back side of the printer, FIG. 12 is a view illustrating a state, in which the control section rotary moves for the device main body, on the back side of the printer, and FIG. 13 is a perspective view illustrating the handling of the flat cables which extend from the cable relay section in a state in which the control section rotary moves for the device main body.

Figure 14:
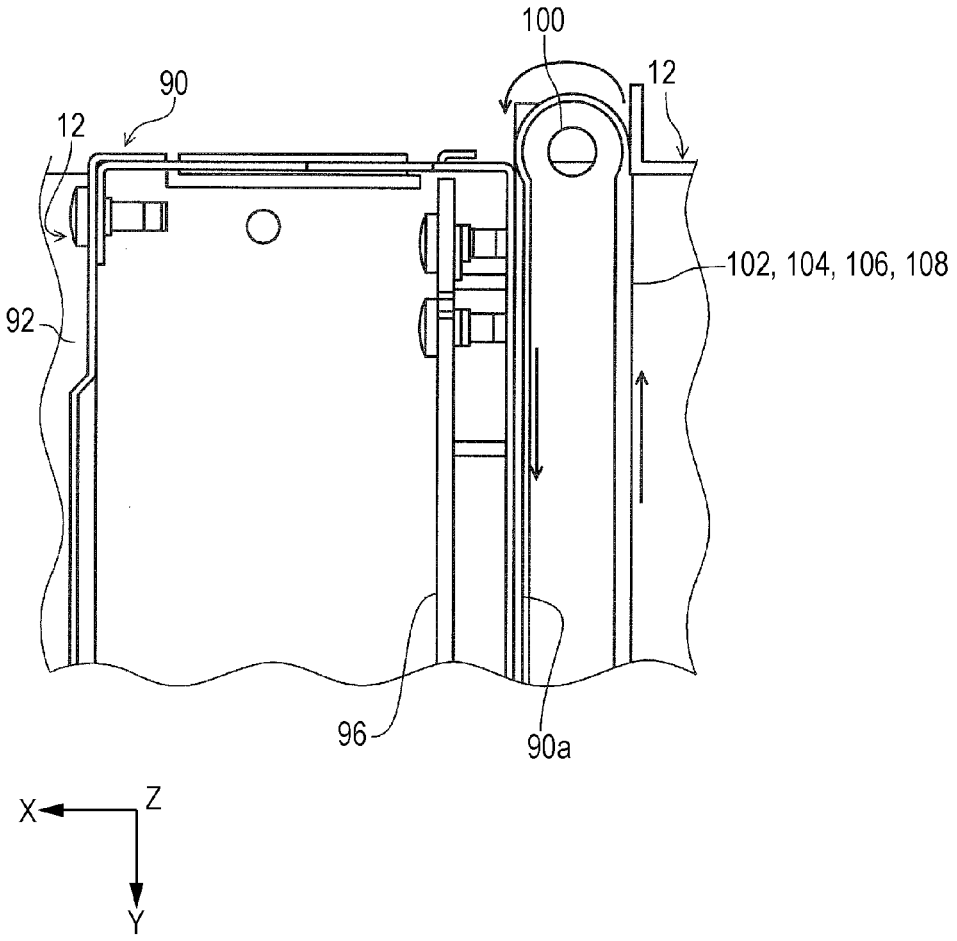
FIG. 14 is a plan view illustrating the handling of the flat cables in the vicinity of the rotary axis which causes the main control section to rotary move.
Figure 15:
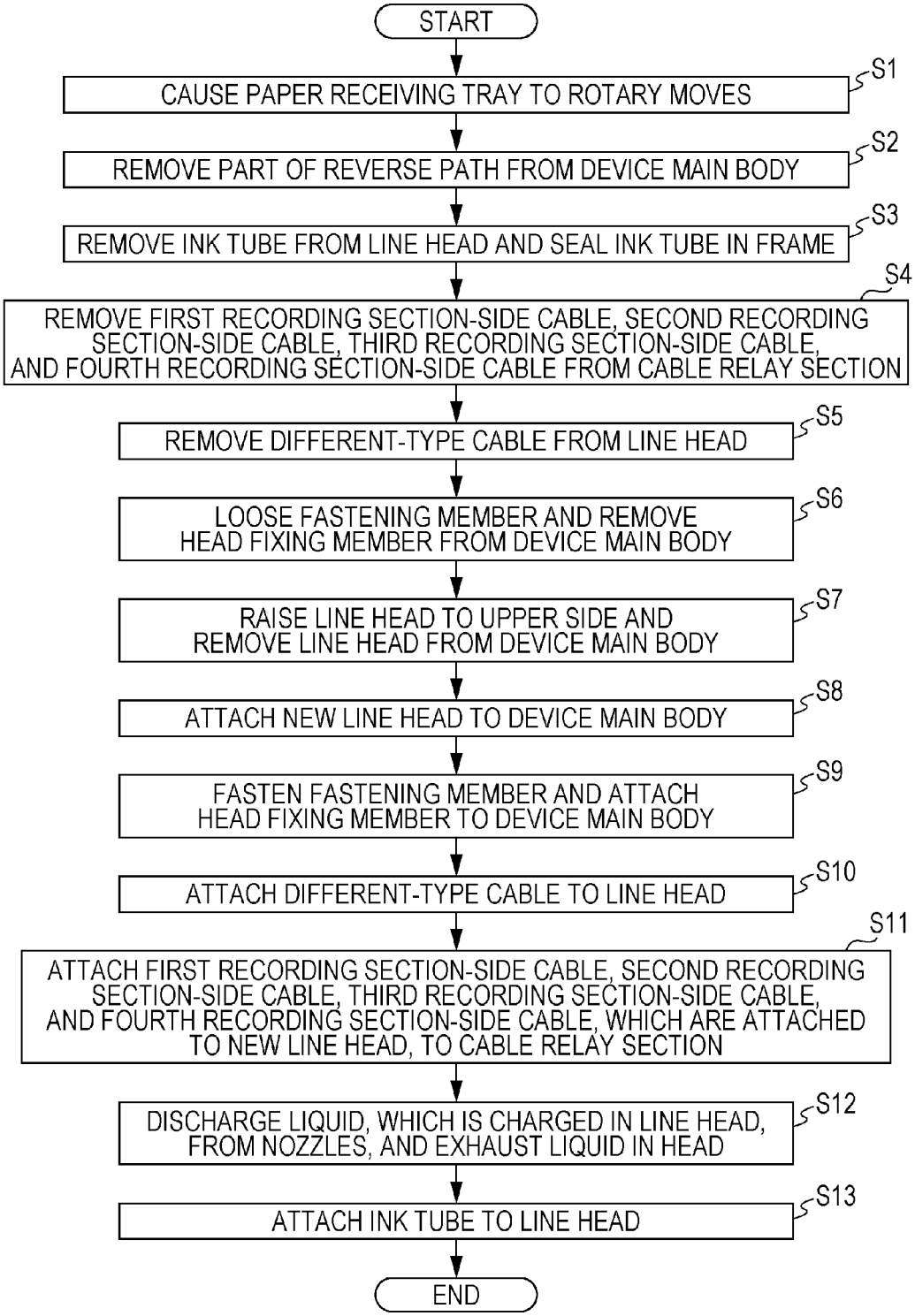
FIG. 15 is flow chart illustrating a line head exchange procedure.
Figure 16:
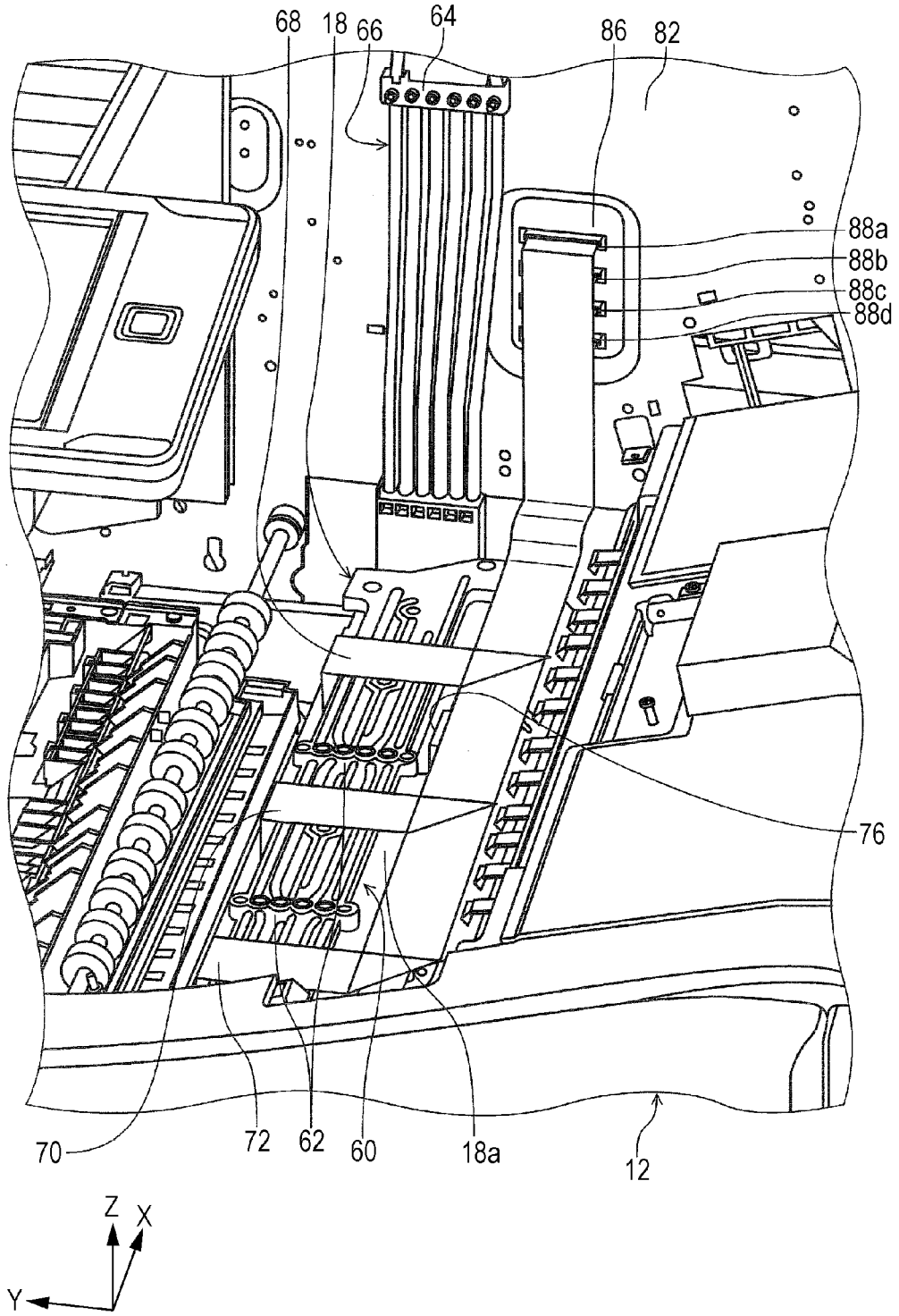
FIG. 16 is a perspective view illustrating a state in which the ink tubes are removed from the line head when the line head is exchanged.
Figure 17:
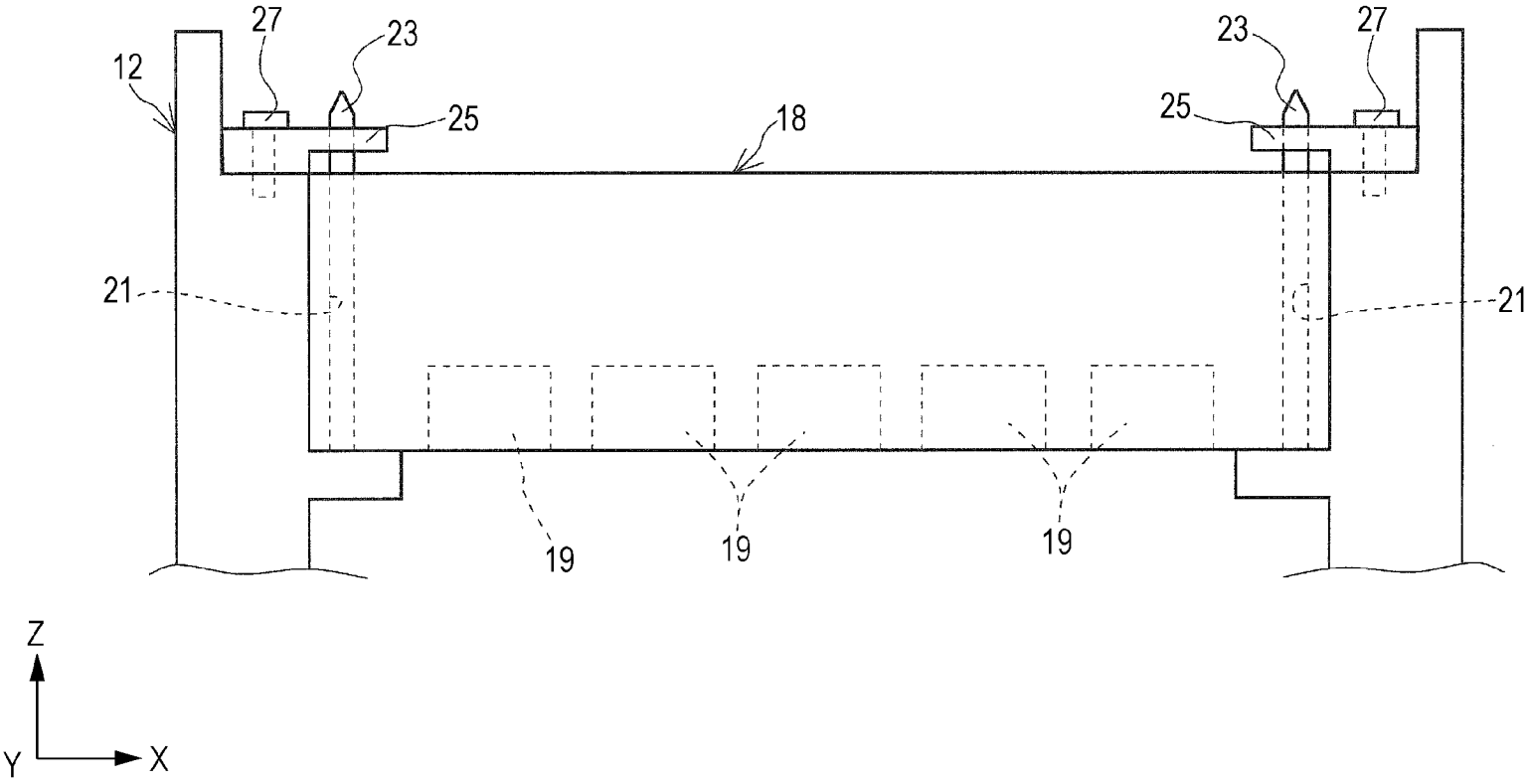
FIG. 17 is a conceptual view illustrating a state in which the line head is attached to the recording section.
Figure 18:
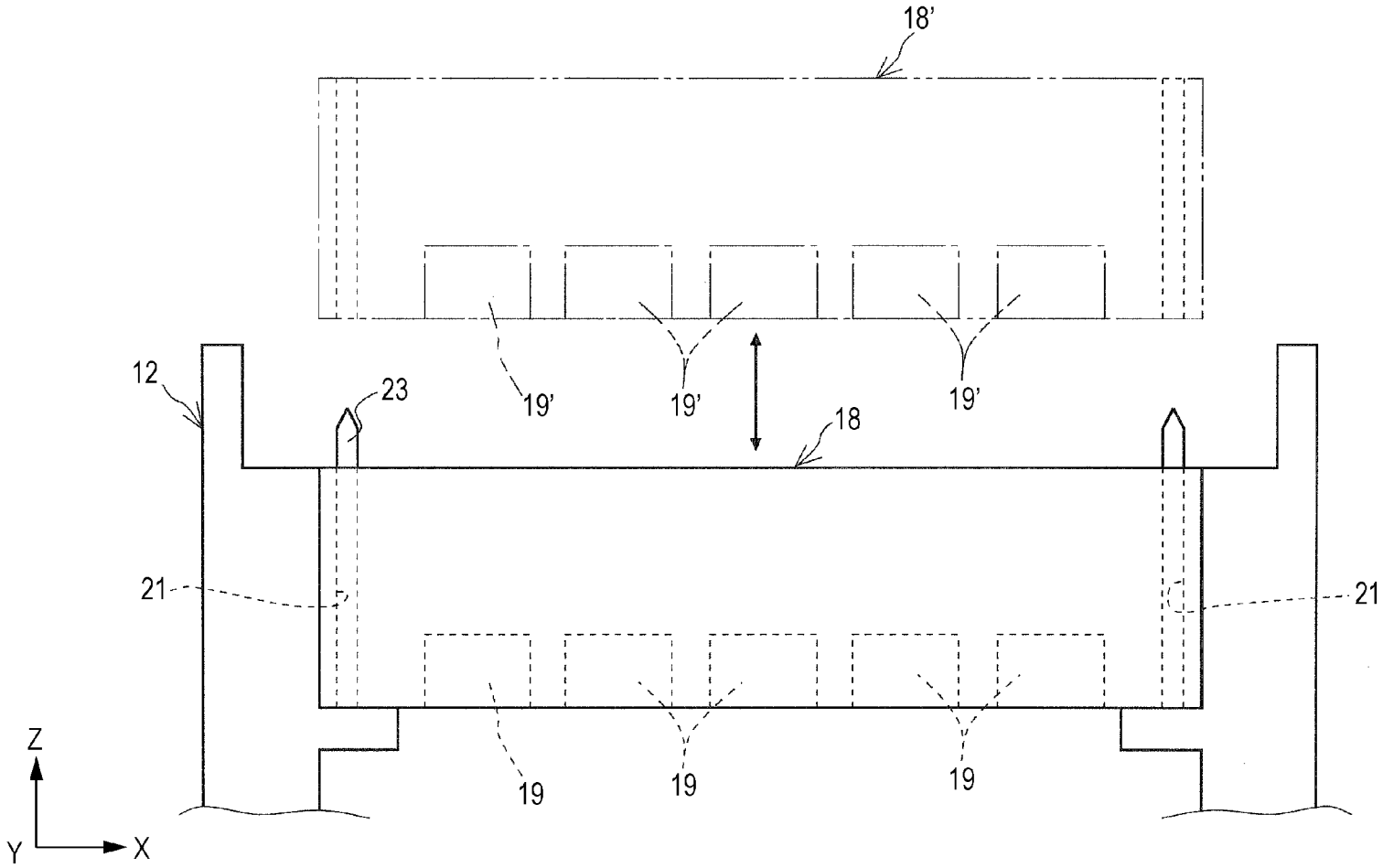
FIG. 18 is a conceptual view illustrating the exchange of the line head in the recording section.
Figure 19:
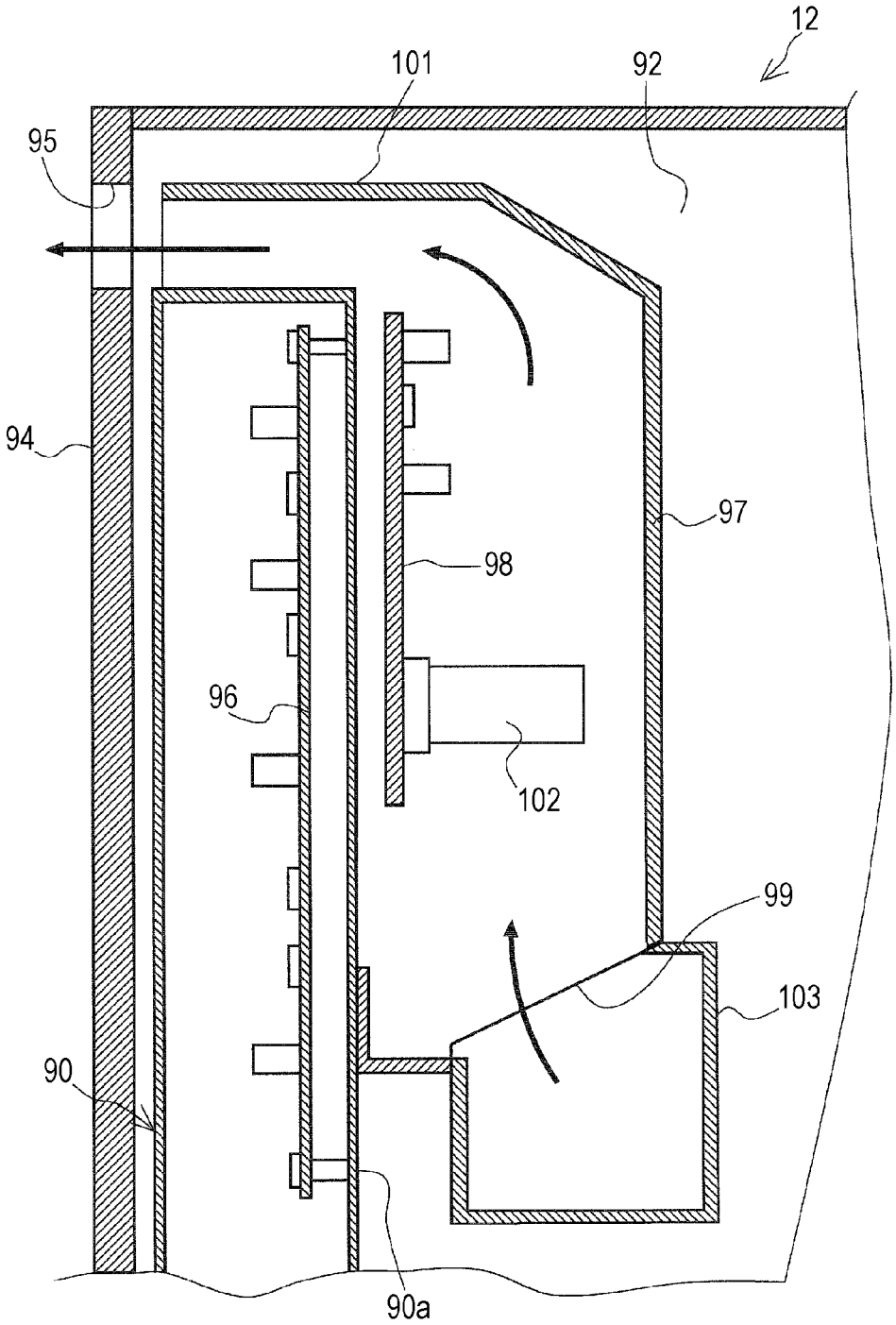
FIG. 19 is an explanation view illustrating a duct connection state acquired when the control section is open for the device main body.
Figure 20:
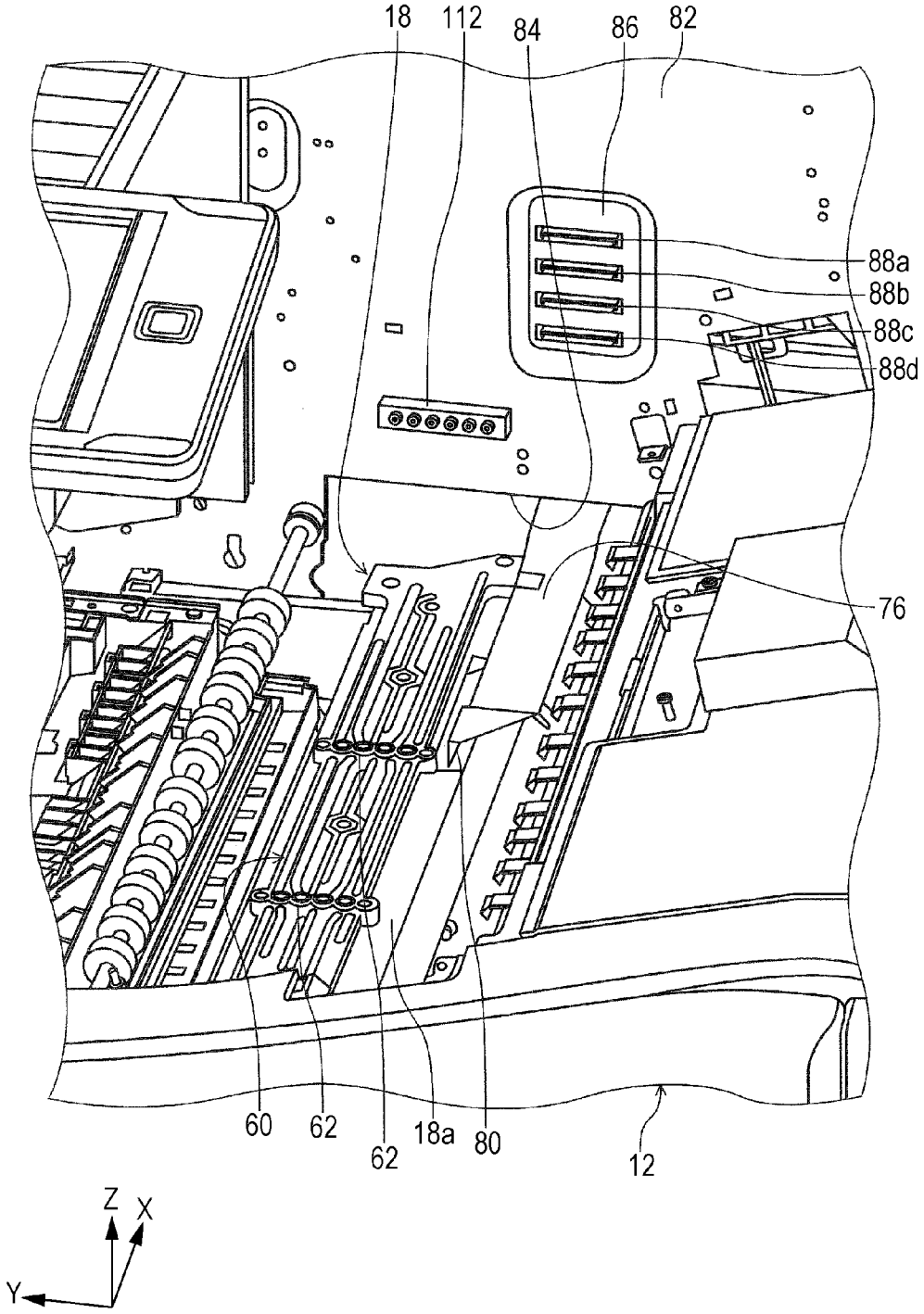
FIG. 20 is an explanation view illustrating a form of a modified example of the embodiment.

FIG. 14 is a plan view illustrating the handling of the flat cables in the vicinity of the rotary axis which causes the main control section to rotary move, FIG. 15 is flow chart illustrating a line head exchange procedure, FIG. 16 is a perspective view illustrating a state in which the ink tubes are removed from the line head when the line head is exchanged, FIG. 17 is a conceptual view illustrating a state in which the line head is attached to the recording section, FIG. 18 is a conceptual view illustrating the exchange of the line head in the recording section, FIG. 19 is an explanatory view illustrating a duct connection state acquired when the control section is open for the device main body, and FIG. 20 is an explanatory view illustrating a form of a modified example of the embodiment.

In addition, in an X-Y-Z coordinate system, which is shown in each drawing, an X direction (device width direction) indicates the entire width direction of paper, a Y direction indicates a paper transport direction, and a Z direction indicates a direction in which the distance (gap) between the recording head and the paper changes, that is, a device height direction. Also, in each drawing, the −X direction is a device front side, and +X direction side is a device back side.

Outline of Printer

An ink jet printer 10 (hereinafter, referred to as a printer 10) will be described as an example of a liquid discharge device with reference to FIG. 1. The printer 10 is configured as a multifunction printer which includes a device main body 12 and a scanner unit 14. The device main body 12 includes a plurality of paper accommodation cassettes 16 which accommodate paper P (refer to FIG. 2) as a "recording medium". Each of the paper accommodation cassettes 16 is attached to be detachable from the front surface side of the device main body 12 (−X axis direction side in FIG. 1). Also, in the specification, the paper P indicates regular paper, thick paper, photograph paper, or the like as an example.

In addition, in the device height direction (Z axis direction) of the device main body 12, a paper receiving tray 20, which receives the paper P on which recording is performed by a line head 18 that will be described later, is provided between the scanner unit 14 and the paper accommodation cassette 16.

Paper Transport Path

Subsequently, a transport path of the paper P in the printer 10 will be described with reference to FIG. 2. Also, in FIG. 2, reference symbols are attached to only the main components of the transport path of the paper P, and the reference symbols are not attached to the other components, particularly, spurs which are provided in plural.

The printer 10 in the embodiment includes a paper transport path 22. The paper transport path 22 includes a straight path 24, a switchback path 26, a reverse path 28, a facedown ejection path 30, and a feed path 32 which is connected to the straight path 24 from the paper accommodation cassette 16.

In the feed path 32, a feeding roller 34, a pair of separating rollers 36, and a pair of transport rollers 38 are sequentially provided along the transport direction of the paper P. The feeding roller 34 is rotationally driven by a driving motor which is not shown in the drawing. The pair of separating rollers 36 separates the paper P by nipping the paper P. The pair of transport rollers 38 includes one roller as a driving roller which is rotationally driven by a driving motor which is not shown in the drawing, and the other roller as a follower roller.

Also, in the description below, description will be performed while it is assumed that each of the pairs of transport rollers in the specification includes one roller which is rotationally driven by a driving motor which is not shown in the drawing, and the other roller as a follower roller.

The paper P, which is accommodated in the paper accommodation cassette 16, is fed to the downstream side of the feed path 32 by the feeding roller 34. The paper P which is fed by the feeding roller 34 is sequentially nipped by the pair of separating rollers 36 and the pair of transport rollers 38, and is fed toward the downstream side of the feed path 32. In addition, a pair of transport rollers 40 is provided on the downstream side of the transport direction of the pair of transport rollers 38.

In the embodiment, the feed path 32 and the straight path 24 are connected to each other in the location of the pair of transport rollers 40. That is, the feed path 32 is set as a path from the paper accommodation cassette 16 to the pair of transport rollers 40.

The straight path 24 is configured as a path which linearly extends. The pair of transport rollers 40, a belt transport part 42, the line head 18 as a "recording section", and a first flap 44 are sequentially provided in the straight path 24 along the transport direction. Also, in the embodiment, the straight path 24 is set as a path from the pair of transport rollers 40 to the first flap 44. That is, the straight path 24 is set as a path which passes through the line head 18 and extends to the upstream side and the downstream side of the line head 18.

In the embodiment, the line head 18 includes a plurality of nozzle heads 19. In the embodiment, the line head 18 is configured to perform recording by discharging ink from a plurality of nozzles, which are provided in the nozzle heads 19, to the recording surface of the paper P when the paper P is transported in an area which faces the nozzle heads 19. The line head 18 according to the embodiment is, for example, a recording head which is provided such that nozzles for discharging ink are arranged to cover the whole area in a paper width direction, and is configured as the recording head which is capable of performing recording in the whole area of the paper width without moving in the paper width direction.

In addition, the belt transport part 42 is arranged in an area which faces the nozzle heads 19 of the line head 18. The belt transport part 42 transports the paper P on the downstream side of the transport direction by driving a belt. At this time, the belt transport part 42 supports a side opposite to the recording surface of the paper P. Further, the recording surface of the paper P, which is supported by the belt transport part 42, faces the nozzle heads 19, and recording is performed on the recording surface of the paper P in such a way that ink is discharged from the nozzles of the nozzle heads 19 of the line head 18. In addition, the belt transport part 42 defines the distance (gap) between the recording surface of the paper P and the head surfaces of the nozzle heads 19 by supporting the paper P from below.

Subsequently, the first flap 44 is located on the downstream side of the transport direction of the line head 18. The first flap 44 is configured to be capable of oscillating through a driving mechanism in which a control section 90 (refer to FIG. 11), which will be described later, performs control. The first flap 44 is configured to be capable of switching between a posture (state in FIG. 2) which connects the straight path 24 to the switchback path 26 and a posture (not shown in the drawing) which connects the straight path 24 to the facedown ejection path 30. Also, a driving mechanism in which the first flap 44 is driven in the embodiment is configured with solenoid. In addition, an operation of switching between the postures of the first flap 44 is controlled by the control section 90 (refer to FIG. 11).

When the first flap 44 has the posture (not shown in the drawing) which connects the straight path 24 to the facedown ejection path 30, the paper P is sent to the facedown ejection path 30 from the straight path 24 by the belt transport part 42.

The facedown ejection path 30 is curved and reversed while extending from the straight path 24 to the upper side in the device height direction. Further, in the facedown ejection path 30, a plurality of pairs of transport rollers 46 is provided in the transport direction at appropriate intervals.

The facedown ejection path 30 includes a path up to an outlet 48 which is located in the downstream side of the transport direction of the pairs of transport rollers 46 which are located on the most downstream side of the transport direction from the first flap 44. That is, the facedown ejection path 30 is a transport path which is connected to the straight path 24, and is a path which causes the paper P that is passed through the line head 18 to be curved, reversed, and ejected.

The paper P, in which recording is performed on the recording surface by the line head 18, is sequentially nipped by the pairs of transport rollers 46 which are sequentially provided from the first flap 44 along the transport direction in the facedown ejection path 30. Further, the paper P is ejected toward the paper receiving tray 20 from the outlet 48.

Here, when the paper P is transported through the facedown ejection path 30, the paper P is transported while a recording surface which is recorded last by the line head 18 to face upward is subsequently transported while the recording surface is caused to be curved toward the inside of the curved part of the facedown ejection path 30, and then is ejected toward the paper receiving tray 20 from the outlet 48 while the recording surface is caused to face downward.

Paper Transport Path in Double-Sided Recording

When the first flap 44 has a posture (refer to FIG. 2) which connects the straight path 24 to the switchback path 26, the paper P is sent to switchback path 26 from the straight path 24 by the belt transport part 42.

The switchback path 26 and the reverse path 28 are paths through which the paper P passes when recording is performed on a second surface after recording is performed on the first surface of the paper P, that is, when double-sided recording is performed. Also, when recording is not performed on the first surface and recording is performed on the second surface, the paper P passes through the switchback path 26 and the reverse path 28 in the same manner. That is, in the specification, the double-sided recording means recording performed on the second surface by reversing the paper P regardless of whether or not recording is performed on the first surface.

The switchback path 26 is located inside the facedown ejection path 30 which is curved and reversed while facing upward in the device height direction, and extends along the facedown ejection path 30. Further, the switchback path 26 includes a pair of transport rollers 50.

In addition, in the embodiment, the switchback path 26 is set as a path from a second flap 52, which is provided on upper side of the first flap 44, to an opening 54 which is provided at the tip of the switchback path 26. When the switchback path 26 is connected to the straight path 24 by the first flap 44 (refer to FIG. 2), the paper P is sent from an area, which faces the line head 18, to the switchback path 26 through first flap 44 by the belt transport part 42. The paper P is sent to a location in which the rear end of the switchback path 26 in the transport direction is nipped by the pair of transport rollers 50.

Also, here, the second flap 52 will be described. The second flap 52 is provided on the upper side of the first flap 44 in the device height direction (Z axis direction). Further, the second flap 52 is interlocked with the operation of the first flap 44 and is oscillated by an interlocking mechanism which is not shown in the drawing. That is, the second flap 52 is controlled by the control section 90 through the first flap 44 and the interlocking mechanism.

The second flap 52 has a posture which connects the switchback path 26 to the reverse path 28 in a state (refer to FIG. 2) in which the first flap 44 connects the straight path 24 to the switchback path 26. On the other hand, the second flap 52 has a posture which connects the switchback path 26 to the reverse path 28 in a state in which the first flap 44 connects the straight path 24 to the facedown ejection path 30.

When the second flap 52 has a posture which connects the switchback path 26 to the reverse path 28, the control section 90 rotates the pair of transport rollers 50 in a direction inverse to the direction in which the paper P is sent to the switchback path 26, and sends the paper P to the reverse path 28 while causing the rear end side of the paper P to be the tip end side. That is, the paper P is switched back.

The reverse path 28 is set as a path which passes through the upper side of the line head 18 from the second flap 52 and reaches the pair of transport rollers 40 of the straight path 24. The plurality of pairs of transport rollers 56 is provided in the transport direction at appropriate intervals in the reverse path 28.

The outlet side of the reverse path 28 is configured to join to the straight path 24 in the upstream location of the pair of transport rollers 40 in the straight path 24. Further, the paper P is sent to the straight path 24 again. That is, the reverse path 28 is a transport path which is connected to the switchback path 26, and is set as a path that reverses the paper P, which is transported in the inverse direction, that is, which is switched back, by causing the upper side of the line head 18 to make a detour, and that causes the paper P to join to the pair of transport rollers 40 which is located in the upper stream-side locations of the line head 18 in the straight path 24.

Further, when the paper P is transported in the reverse path 28, the first surface and the second surface are reversed and transported to an area which faces the line head 18 in the straight path 24, and then recording is performed on the second surface. Thereafter, the paper P is ejected to the paper receiving tray 20 through the facedown ejection path 30.

Embodiment

The handling of the line head 18, which is arranged in the device main body 12, and flat cables from the control section 90, which will be described later, will be described with reference to FIGS. 2 to 8B and FIGS. 17 and 18. When FIGS. 2 and 3 are referred to, the paper receiving tray 20 is configured to be capable of rotating for the device main body 12 while using a rotary axis 58 as a rotary fulcrum. Specifically, the paper receiving tray 20 rotary moves between the posture (refer to a solid line part in FIG. 2) which receives the paper P which is ejected from the outlet 48 of the facedown ejection path 30 and the posture (refer to two short-dashed line parts in FIG. 2 and refer to FIG. 3) which opens the reverse path 28.

As illustrated in FIG. 3, when a posture is adopted which causes the paper receiving tray 20 to rotary move for the device main body 12, and which opens the reverse path 28, a part of the reverse path 28 is exposed. Specifically, a path part 28*a*, which passes through the upper side of the line head 18 in the reverse path 28, is exposed. In the embodiment, the path part 28*a*, which is included in the part of the reverse path 28 and which passes through the upper side of the line head 18, is configured to be detachable from the device main body 12. As shown in FIG. 4, when the path part 28*a*, which passes through the upper side of the line head 18, is detached from the device main body 12, the upper part of the line head 18 is exposed.

The line head 18 forms an approximately rectangular parallelepiped shape on the whole, and the plurality of nozzle heads 19 is arranged on the lower surface of the line head 18 (refer to FIG. 17). In addition, as illustrated in FIG. 17, through holes 21 are provided in the longitudinal direction of the line head 18, that is, at the ends in the backward-forward direction of the device. In addition, in the device main body 12, a pair of guide pins 23 and 23 is provided at intervals in the backward-forward direction of the device. In the embodiment, the distance between the guide pin 23 and the guide pin 23 corresponds to the distance between the through hole 21 and the through hole 21 in the line head 18.

The line head 18 is attached to the device main body 12 in a state in which the guide pins 23 are inserted into the through holes 21. That is, the guide pins 23 function as guide members when the line head 18 is attached to the device main body 12, and also function as the positioning members of the line head 18 for the device main body 12.

In a state in which the line head 18 is attached to the device main body 12, guide pin stabilizing members 25 are arranged in the device main body 12 so as to face an upper surface 18*a* of the line head 18. In the guide pin stabilizing members 25, the through holes 21, which receive the guide pins 23, are provided. When the guide pin stabilizing members 25 cause fastening members 27 to close the device main body 12 in a state in which the guide pins 23 are received, it is possible to stabilize the horizontal locations of the guide pins 23. Also, in the embodiment, the fastening members 27 are configured as screws.

In addition, as illustrated in FIG. 5, ink supply paths 60 for supplying ink as "liquid" to nozzles which are provided in the plurality of nozzle heads, are provided on the upper surface 18*a* of the line head 18. The ink supply paths 60 are provided to correspond to the colors of ink which is supplied to the nozzle heads, and, in the embodiment, correspond to four colors, that is, black, cyan, magenta, and yellow.

In addition, at least one ink supply section 62 is provided in the ink supply path 60. As illustrated in FIG. 4, a plurality of ink tubes 66 is connected to the ink supply section 62 through ink supply connectors 64. One set of the ends of the plurality of ink tubes 66 are connected to the ink supply connectors 64, and are detachable from the ink supply section 62. In addition, although not shown in the drawing, the other set of the ends of the plurality of ink tubes 66 are connected to an ink tank (not shown in the drawing) as a "liquid accommodation section" which is provided in the device main body 12. Therefore, ink is supplied to the nozzles of the nozzle heads 19 of the line head 18 from the ink tank. Also, in the embodiment, the ink tank is provided to correspond to the four colors, that is, black, cyan, magenta, and yellow, and the other set of the ends of the ink tubes corresponding to the respective colors are connected thereto. Also, in FIG. 4, the plurality of ink tubes 66 includes six ink tubes. However, two of the ink tubes 66, which extend to the device front surface side, may be configured to supply air to the line head 18.

In addition, in the embodiment, five flat cables are attached to the upper surface 18*a* of the line head 18. In the embodiment, the five flat cables include a first recording section-side cable 68, a second recording section-side cable 70, a third recording section-side cable 72, a fourth recording section-side cable 74, and a different-type cable 76. In the embodiment, the first recording section-side cable 68, the second recording section-side cable 70, the third recording section-side cable 72, the fourth recording section-side cable 74 and the different-type cable 76 are configured as flexible flat cables (FFCs).

In addition, in the embodiment, the first recording section-side cable 68, the second recording section-side cable 70, the third recording section-side cable 72, and the fourth recording section-side cable 74 are configured as flexible flat cables (FFCs) according to the same signal standard, and the different-type cable 76 is configured as a high-speed data transmission cable in which the data transmission speed is higher than the other cables. In addition, in the embodiment, a ready-made adapter (not shown in the drawing) is attached to one end side of the different-type cable 76, that is, the upper surface 18*a* of the line head 18. Also, in the embodiment, a ready-made adapter is also attached to the other end side of the different-type cable 76.

Specifically, as illustrated in FIG. 5, attachment sections 78*a*, 78*b*, 78*c*, 78*d*, and 80 of the respective cables are provided on the upper part of the line head 18. The attachment sections 78*a*, 78*b*, and 78*c* are arranged at the set of the ends of the line head 18 on the downstream side of the paper transport direction at proper distances in the paper width direction. One end of the first recording section-side cable 68 is retractably attached to the attachment section 78*a*, one end of the second recording section-side cable 70 is retractably attached to the attachment section 78*b*, and one end of the third recording section-side cable 72 is retractably attached to the attachment section 78*c*.

In addition, the attachment section 78*d* and the attachment section 80 are arranged side by side in the paper width direction at the end on the upstream side of the paper transport direction in the line head 18. One end of the fourth recording section-side cable 74 is retractably attached to the attachment section 78*d*. In addition, the attachment section 80 corresponds to an adapter which is provided on one end side of the different-type cable 76, and an adapter which is provided on one end side of the different-type cable 76 is detachable therefrom. Accordingly, as will be described later, it is easy to reuse the different-type cable 76 when the line head 18 is temporarily exchanged.

Subsequently, as illustrated in FIG. 7, setting is performed such that the different-type cable 76 is located at the lowermost position in the device height direction among the five flat cables 68, 70, 72, 74, and 76 which are attached to the line head 18 in a state in which the different-type cable 76 is attached to the line head 18. Further, the different-type cable 76 which is attached to the attachment section 80 of the line head 18 extends from the line head 18 to a device back side in the backward-forward direction of the device.

In the embodiment, on the device back side of the line head 18 of the device main body 12, a frame 82, which divides an area in which the paper transport path 22 and the line head 18 are arranged and an area in which the control section 90 which will be described later is arranged, is provided.

A part of the frame 82 is cut and a cable passing section 84 is provided at the cut part. The different-type cable 76 extends toward the control section 90 which is provided on the device back side through the cable passing section 84 and which will be described later.

In addition, a recess section 86 is provided on the upper side of the cable passing section 84 of the frame 82. The recess section 86 is formed in a concave state on an area side of the frame 82 in which the line head 18 is arranged, and is formed in a convex state on an area side in which the control section 90 is arranged (refer to FIGS. 6A to 8A). As illustrated in FIG. 8A, a cable relay section 88 is provided on an area side in which the control section 90 of the recess section 86 is arranged.

Attachment sections 88*a*, 88*b*, 88*c*, and 88*d*, which retractably attach the flexible flat cables (FFCs), are provided on one side of the cable relay section 88, that is, on the area side in which the line head 18 is arranged. In addition, attachment sections 88*e*, 88*f*, 88*g*, and 88*h*, which retractably attach the flexible flat cables (FFCs), are provided on the other side, that is, on the area side in which the control section 90 is arranged.

Here, in the embodiment, the attachment section 88*a* and the attachment section 88*e* are electrically connected to each other, the attachment section 88*b* and the attachment section 88*f* are electrically connected to each other, the attachment section 88*c* and the attachment section 88*g* are electrically connected to each other, an attachment section 88*d* and an attachment section 88*h* are electrically connected to each other.

In addition, as illustrated in FIG. 6A, in the recess section 86, the positions of the cable relay section 88, which correspond to the attachment sections 88*a*, 88*b*, 88*c*, and 88*d*, are open, and thus the attachment sections 88*a*, 88*b*, 88*c*, and 88*d* are exposed to the area side in which the line head 18 is arranged.

In the embodiment, the fourth recording section-side cable 74, which extends from the attachment section 78*d* of the line head 18, is located on the upper side of the different-type cable 76 which extends in the device rear direction, extends to the device back side, and is retractably attached to the other end of the attachment section 88*d* in the recess section 86 of the frame 82.

In addition, the third recording section-side cable 72, which extends from the attachment section 78*c* of the line head 18, laterally cuts the upper surface 18*a* of the line head 18 from the downstream side of the paper transport direction toward the upstream side, changes direction to the device back side, and extends to the device back side. At this time, the third recording section-side cable 72 is located on the upper side of the fourth recording section-side cable 74. Further, the other end of the third recording section-side cable 72, which extends to the device back side, is retractably attached to the attachment section 88*c* in the recess section 86 of the frame 82.

In addition, the second recording section-side cable 70, which extends from the attachment section 78*b* of the line head 18, laterally cuts the upper surface 18*a* of the line head 18 from the downstream side of the paper transport direction toward the upstream side, changes direction to the device back side, and extends to the device back side. At this time, the second recording section-side cable 70 is located on the upper side of the third recording section-side cable 72. Further, the other end of the second recording section-side cable 70, which extends to the device back side, is retractably attached to the attachment section 88*b* in the recess section 86 of the frame 82.

In addition, the first recording section-side cable 68, which extends from the attachment section 78*a* of the line head 18, laterally cuts the upper surface 18*a* of the line head 18 from the downstream side of the paper transport direction toward the upstream side, changes direction to the device back side, and extends to the device back side. At this time, the first recording section-side cable 68 is located on the upper side of the second recording section-side cable 70. Further, the other end of the first recording section-side cable 68, which extends to the device back side, is retractably attached to the attachment section 88*a* in the recess section 86 of the frame 82.

Also, in the embodiment, as illustrated in FIG. 4, on the upper surface 18*a* of the line head 18, the ink tubes 66 are arranged on the upper sides of the first recording section-side cable 68, the second recording section-side cable 70, and the third recording section-side cable 72 which laterally cut the line head 18 in the paper transport direction.

Control Section

The control section 90 will be described with reference to FIGS. 9 to 14. As illustrated in FIGS. 9 and 10, a control section accommodation section 92, which accommodates the control section 90, is provided on the back side of the device main body 12, and the control section accommodation section 92 is covered by an exterior cover 94. In the embodiment, the exterior cover 94 configures a part of the exterior of the device main body 12. In addition, although will be described later, an ejection port 95 is provided in the exterior cover 94. As illustrated in FIG. 10, when the exterior cover 94 is removed from the device main body 12, the control section accommodation section 92 is exposed. The control section 90 is installed in the control section accommodation section 92.

The control section 90 includes a main control substrate 96 (refer to FIG. 11) which is arranged in a box-shaped housing, and a line head driving substrate 98 which is arranged on a side that faces the frame 82 in the box-shaped housing, that is, on the rear surface 90*a* of the control section 90. In the embodiment, the main control substrate 96 and the line head driving substrate 98 are configured as an electric circuit which includes a plurality of electronic components.

The control section 90 controls operations, which are necessary to execute the recording and image reading of the printer 10, such as operations of feeding, transporting, ejecting, and recording the paper P, a manuscript reading operation, and a maintenance operation, in the scanner unit 14, the line head 18, the belt transport part 42, the first flap 44, and the second flap 52. In addition, in the embodiment, the control section 90 controls the driving of the feeding roller 34, the pair of separating rollers 36, and the respective pairs of transport rollers 38, 40, 46, 50, and 56 through a plurality of driving motors (not shown in the drawing) provided in the device main body 12.

In addition, the control section 90 may control the operations, which are necessary to execute the recording and image reading of the printer 10, such as the manuscript reading operation based on an instruction from the outside (PC or the like). In addition, the control section 90 controls the discharge of ink performed by the line head 18.

In addition, in the embodiment, the control section 90 is configured to be capable of rotating the device main body 12 while using the rotary axis 100 (refer to FIGS. 11 and 14), which is provided at the end of the upstream side of the paper transport direction, as a fulcrum. Specifically, the control section 90 may acquire a state (refer to FIG. 10) which is accommodated in the control section accommodation section 92 and a maintenance state (refer to FIGS. 12 and 13) which rotary moves for the device main body 12 and performs maintenance operation.

As illustrated in FIG. 12, a line head driving substrate accommodation section 97 is provided on the rear surface 90*a* of the control section 90. A line head driving substrate 98 is arranged in the line head driving substrate accommodation section 97. In the embodiment, the line head driving substrate accommodation section 97 is formed as a box-shaped housing, and a duct inlet port 99 is provided under the line head driving substrate accommodation section 97. The duct inlet port 99 is formed as an inclined surface which is inclined in the backward-forward direction of the device. In addition, a duct ejection port 101 is provided at the upper part of the line head driving substrate accommodation section 97.

In addition, as illustrated in FIG. 12, a cooling duct connection section 103 is provided on the side of the frame 82 of the control section accommodation section 92. Gas is blown into the cooling duct connection section 103 from a cooling fan (not shown in the drawing) which is provided in the device main body 12. The opening part of the cooling duct connection section 103 is configured as an inclined surface which is inclined in the backward-forward direction of the device.

In addition, as illustrated in FIG. 19, in a state in which the control section 90 is accommodated in the control section accommodation section 92, the cooling duct connection section 103 is connected to the duct inlet port 99 of the line head driving substrate accommodation section 97. Also, in the embodiment, a configuration is made such that the inclination of the inclined surface of the duct inlet port 99 is approximately identical to the inclination of the inclined surface of the opening part of the cooling duct connection section 103.

Gas, which is blown from the cooling duct connection section 103 line head driving substrate, flows into the accommodation section 97 through the duct inlet port 99, cools the line head driving substrate 98, passes through the ejection port 95 which is provided in the exterior cover 94 through the duct ejection port 101, and is discharged to the outside of the device main body 12.

Referring to FIGS. 8B and 13, one end of a first control section-side cable 102 is retractably attached to the attachment section 88*e* of the cable relay section 88. Here, the attachment section 88*e* is electrically connected to the attachment section 88*a*, and thus the first control section-side cable 102, which is attached to the attachment section 88*e*, is electrically connected to the first recording section-side cable 68 which is attached to the attachment section 88*a*.

In addition, one end of a second control section-side cable 104 is retractably attached to the attachment section 88*f* of the cable relay section 88. The second control section-side cable 104 is electrically connected to the second recording section-side cable 70 through the attachment section 88*f* and the attachment section 88*b*. One end of a third control section-side cable 106 is retractably attached to the attachment section 88*g* of the cable relay section 88. The third control section-side cable 106 is electrically connected to the third recording section-side cable 72 through the attachment section 88*g* and the attachment section 88*c*.

In addition, one end of a fourth control section-side cable 108 is retractably attached to the attachment section 88*h* of the cable relay section 88. The fourth control section-side cable 108 is electrically connected to the fourth recording section-side cable 74 through the attachment section 88*h* and the attachment section 88*d*.

As illustrated in FIGS. 12 to 14, the first control section-side cable 102, the second control section-side cable 104 and the third control section-side cable 106, which respectively extend toward the downward side of the device height direction from the attachment sections 88*e*, 88*f*, and 88*g* of the cable relay section 88, change the extending direction into an upstream side of the paper transport direction, and extend to the upstream side of the paper transport direction. Further, the respective other set of the ends of the first control section-side cable 102, the second control section-side cable 104, and the third control section-side cable 106 move around the rotary axis 100 of the control section 90, extend along the rear surface 90*a* of the control section 90, and are retractably connected to the line head driving substrate 98 of the rear surface 90*a* of the control section 90.

In addition, the fourth control section-side cable 108, which extends toward the downward side of the device height direction from the attachment section 88*e* of the cable relay section 88, changes the extending direction into the upstream side of the paper transport direction, and extends to the upstream side of the paper transport direction. Further, the other end of the fourth control section-side cable 108 moves around the rotary axis 100 of the control section 90, extends along the rear surface 90*a* of the control section 90, and is retractably connected to the main control substrate 96 through the opening 110 which is provided on the rear surface 90*a* of the control section 90.

In addition, the different-type cable 76, which has one end that is connected to the line head 18, passes through the cable passing section 84, extends into an area in which the control section 90 is arranged, changes the extending direction into the upstream side of the paper transport direction, and extends to the upstream side of the paper transport direction. Further, the other end of the different-type cable 76 moves around the rotary axis 100 of the control section 90, extends along the rear surface 90*a* of the control section 90, and is retractably connected to the main control substrate 96 through the opening 110 which is provided on the rear surface 90*a* of the control section 90.

Line Head Exchange Procedure

Subsequently, a procedure of exchanging the line head 18 will be described with reference to FIG. 15. In step S1, the paper receiving tray 20 rotary moves for the device main body 12, and thus a part of the reverse path 28 is exposed (refer to FIG. 3). Subsequently, in step S2, the path part 28*a* which is located on the upper side of the line head 18 in the reverse path 28 is removed from the device main body 12, and thus the line head 18 is exposed (refer to FIG. 4). Subsequently, in step S3, the ink supply connectors 64 of the ink tubes 66 are removed from the ink supply section 62 of the ink supply path 60 which is provided on the upper surface 18*a* of the line head 18, and thus the ink tubes 66 are sealed by a hook (not shown in the drawing) which is provided in the frame 82 (FIG. 16).

Subsequently, in step S4, the first recording section-side cable 68, the second recording section-side cable 70, the third recording section-side cable 72, and the fourth recording section-side cable 74 are removed from the cable relay section 88 which is provided in the frame 82 (refer to FIG. 7). Further, in step S5, the different-type cable 76 is removed from the line head 18.

Subsequently, in step S6, the fastening members 27 are loosened from the device main body 12, and thus the guide pin stabilizing members 25 is removed from the device main body. Further, in step S7, the line head 18 is raised to the device main body 12 to the upper side of the device height direction, and thus the line head 18 is removed from the device main body 12 (refer to FIG. 18). Also, in FIG. 18, two short-dashed line part and reference symbol 18' indicate the line head 18 in a state of being removed from the device main body 12, and the reference symbols 19' indicate the head nozzles of the line head 18 in a state of being removed.

Subsequently, in step S8, a new line head 18 is attached to the device main body 12 while causing the guide pins 23 to pass through the through holes 21 (refer to FIG. 18). Further, in step S9, the guide pins 23 are caused to pass through the guide pin stabilizing members 25, and thus the fastening members 27 is fastened to the device main body 12. Therefore, the horizontal locations of the guide pins 23 are stable, with the result that it is possible to smoothly attach or detach the line head 18 to or from the device main body 12, and thus it is possible to prevent the guide pins 23 from being inclined due to an elevating motion when a mechanism in which the line head 18 elevates according to the kind of the paper is provided.

Subsequently, in step S10, the different-type cable 76, which extends from the control section 90, is attached to the exchanged line head 18 (refer to FIG. 7). Further, in step S11, the first recording section-side cable 68, the second recording section-side cable 70, the third recording section-side cable 72, and the fourth recording section-side cable 74, which are attached to the exchanged line head 18, are connected to the cable relay section 88 which is provided in the frame 82 (refer to FIG. 16).

Further, in step S12, liquid, which is charged in the ink supply path 60 and the nozzle heads 19 of the exchanged line head 18, is discharged from the nozzles of the nozzle heads 19, and liquid is ejected from the insides of the ink supply path 60 and the nozzle heads 19. Also, liquid, which is charged in the ink supply path 60 and the nozzle heads 19, is liquid which is charged in the ink supply path 60 and the nozzle heads 19 for the purpose of protecting the line head 18 when the line head 18 is transported.

Subsequently, in step S13, the ink tubes 66, which are sealed by the hook (not shown in the drawing) of the frame 82, are removed from the hook, and the ink supply connectors 64 are attached to the ink supply section 62 of the ink supply path 60 of the line head 18. The flow of the work for exchanging the line head 18 has been described above.

When the above description is summarized, in the embodiment, the arrangement area of the detachable line head 18 which performs recording on the paper P and the arrangement area of the control section 90 which performs various types of control are divided by the frame 82. Further, the cable relay section 88 is provided in the frame 82, the recording section-side cables 68, 72, 74, and 76, which extend from the line head 18, and the control section-side cables 102, 104, 106, and 108, which extend from the control section 90, are connected to the cable relay section 88. Therefore, when a work of maintaining or exchanging the line head 18 is performed, it is not necessary to access to the control section 90, access to the cable relay section 88 is sufficient. Therefore, workability acquired when the work of maintaining or exchanging the line head 18 is performed is excellent, and thus it is possible to shorten work time.

In the embodiment, the recess section 86, which becomes concave on the arrangement area side of the line head 18 and becomes convex on the arrangement area side of the control section 90, is formed in the frame 82. Further, the cable relay section 88 is provided in the recess section 86. Therefore, it is possible to reduce the amount of projection of the cable relay section 88 toward the arrangement area side of the line head 18 or it is possible to prevent protrusion. Accordingly, when the line head 18 is attached or detached, it is possible to suppress the line head 18 from being caught by the cable relay section 88, and thus a work of attaching or detaching the line head 18 becomes easier.

In the embodiment, the different-type cable 76, which is a flat cable based on different standard, passes through the cable passing section 84 and is directly connected to the line head 18 and the control section 90, and thus the recording section-side cables 68, 72, 74, and 76 and the control section-side cables 102, 104, 106, and 108 can perform excellent information transmission, in which signal deterioration is suppressed, by using the different-type cable 76. In addition, the different-type cable 76 is configured to be detachable from the line head 18, and thus it is easy to reuse the different-type cable 76 when the line head 18 is exchanged.

In the embodiment, on the upper surface 18*a* of the line head 18, the recording section-side cables 68, 72, 74, and 76 are wired on the upper side of the different-type cable 76, and thus the different-type cable 76 does not disturb a work performed when the recording section-side cables 68, 72, 74, and 76 are retracted into the cable relay section 88, thereby increasing workability.

According to the embodiment, the ink tubes 66, which supply ink from the ink tank that accommodates ink to the line head, are included. The ink tubes 66 are arranged on the upper sides of the recording section-side cables 68, 72, and 74 and extend to the outside of the line head 18, and thus the recording section-side cables 68, 72, 74, and 76 are not disturbed when the work of removing the ink tubes 66 is performed, thereby increasing workability.

Modified Example of Embodiment (1) In the embodiment, the different-type cable 76 is configured to directly connect the line head 18 to the control section 90. However, instead of the configuration, the different-type cable 76 may be configured to connect the line head 18 to the control section 90 through the cable relay section 88.

(2) In the embodiment, a configuration is made such that the cable which controls the line head 18 is connected through the cable relay section 88. However, instead of the configuration, a configuration may be made such that sensors and motors in the control cable device main body 12 of the scanner unit 14, communication cables of a manipulation section which is manipulated by a user, electric power supply cables, and wirings of a power supply unit are connected to the control section 90 through the cable relay section 88.

(3) In the embodiment, a configuration is made such that, when the line head 18 is exchanged, the first recording section-side cable 68, the second recording section-side cable 70, the third recording section-side cable 72, and the fourth recording section-side cable 74 are exchanged together with a new line head 18. However, the first recording section-side cable 68, the second recording section-side cable 70, the third recording section-side cable 72, and the fourth recording section-side cable 74, which are attached to the used line head 18, may be removed from the used line head 18 and may be attached to a new line head 18.

(4) In the embodiment, a configuration is made such that the ink tank (not shown in the drawing), which is provided in the device main body 12, is connected to the ink supply section 62, which is provided in the upper surface 18*a* of the line head 18, using the plurality of ink tubes 66. However, instead of the configuration, as illustrated in FIG. 20, a configuration may be made such that the tube relay section 112 is provided in the frame 82, the ink tank is connected to the tube relay section 112 using the control side tube (not shown in the drawing), and tube relay section 112 is connected to the ink supply section 62 using a recording section side tube (not shown in the drawing).

Also, in the modified example, the control side tube and the recording section side tube are configured as a plurality of ink tubes which supplies ink. In addition, in the tube relay section 112, the connectors corresponding to the number of ink tubes are provided. In addition, at the respective tips of the control section side tube and the recording section side tube, the adapters which are connected to the connectors are provided. In addition, adapters are provided on the side of the control section side tube which is connected to the ink supply section 62 of the line head 18. Configuration is made such that the adapters which are provided in the connectors and ink tubes which are provided in the tube relay section 112 permits ink supply when the connectors are connected to the adapters, and the leak of ink from the connectors and adapters is prevented when the connectors are not connected to the adapters. As an example of the configuration, a fluid coupling coupler is provided. In the modified example, the connectors and the adapters are configured as fluid coupling couplers. That is, when at least one of the control side tube and the recording section side tube is separated from the tube relay section 112 or when the control side tube is separated from the ink supply section 62, it is possible to prevent ink from leaking from the ink tube or the tube relay section 112.

With such a configuration, the arrangement area of the detachable line head 18 which performs recording on the paper P and the arrangement area of the control section 90 which performs various types of control are partitioned by the frame 82. Further, the tube relay section 112 is provided in the frame 82 and the recording section side tube, which is provided on the arrangement area side of the line head 18, and the control section side tube, which is provided on the side of the arrangement area of the control section 90, is connected to the tube relay section 112. Therefore, it is not necessary to access the ink tank which is provided inside of the device when the work of maintaining or exchanging the line head 18 is performed, and access to the tube relay section 112 is sufficient. Therefore, workability, acquired when the work of maintaining or exchanging the line head 18 is performed, is excellent, and thus it is possible to reduce work time.

Further, when the above description is summarized, the printer 10 includes the detachable line head 18 which performs recording on the paper P, the frame 82 which performs division into the arrangement area of the line head 18 and the arrangement area of the control section 90 that performs various types of control, the cable relay section 88 which is provided in the frame 82, the first recording section-side cable 68, the second recording section-side cable 70, the third recording section-side cable 72, and the fourth recording section-side cable 74 which are flat cables that extend from the line head 18 and which are retractably connected to the cable relay section 88 on the arrangement area side of the line head 18, and the first control section-side cable 102, the second control section-side cable 104, the third control section-side cable 106 and the fourth control section-side cable 108 which are flat cables that extend from the control section 90 and which are connected to the cable relay section 88 on the arrangement area side of the control section 90.

In addition, in the frame 82 of the printer 10, the recess section 86, which becomes concave on the arrangement area side of the line head 18 and becomes convex on the arrangement area side of the control section 90, is formed. Further, the cable relay section 88 is provided in the recess section 86.

In addition, in the frame 82 of the printer 10, the cable passing section 84 is provided, and the different-type cable 76, which is the flat cable according to signal standard that is different from those of the first recording section-side cable 68, the second recording section-side cable 70 and the third recording section-side cable 72, the fourth recording section-side cable 74, the first control section-side cable 102, the second control section-side cable 104, the third control section-side cable 106, and the fourth control section-side cable 108, directly connects the line head 18 to the control section 90 through the cable passing section 84. The different-type cable 76 is configured to be detachable from the line head 18.

In addition, in the printer 10, the first recording section-side cable 68, the second recording section-side cable 70, the third recording section-side cable 72, the fourth recording section-side cable 74, and the different-type cable 76 are wired along the upper surface 18*a* of the line head 18 and extend to the outside of the outline head 18. On the upper surface 18*a* of the line head 18, the first recording section-side cable 68, the second recording section-side cable 70, the third recording section-side cable 72, and the fourth recording section-side cable 74 are wired on the upper side of the different-type cable 76.

In addition, the ink tubes 66, which supply ink from the ink tank that accommodates ink to the line head 18, are included in the printer 10. The ink tubes 66 are arranged on the upper sides of the first recording section-side cable 68, the second recording section-side cable 70, and the third recording section-side cable 72, and extend to the outside of the line head 18.

In addition, the printer 10 includes the detachable line head 18 which performs recording on the paper P, the frame 82 which performs division into the arrangement area of the line head 18 and the arrangement area of the control section 90 that performs various types of control, the tube relay section 112 which is provided in the frame 82, the recording section side tube which is an ink supply tube that is provided on the arrangement area side of the line head 18 and is retractably connected to the tube relay section 112 on the arrangement area side of the line head 18, and the control section side tube which is the ink supply tube that is provided on the arrangement area side of the control section 90 and which is connected to the tube relay section 112 on the arrangement area side of the control section 90.

Also, in the embodiment, the line head 18 as a recording head is a type which discharges liquid in a fixed state without moving. However, the invention is not limited thereto. It is possible to apply the invention to a type in which liquid is discharged from the nozzles of the recording head while the recording head moves in a predetermined direction.

In addition, in the embodiment, the recording section-side cables 68, 70, 72, and 74, the control section-side cables 102, 104, 106, and 108, the different-type cable 76 and the cable relay section 88 according to the invention are applied to the ink jet printer as an example of the recording apparatus. However, it is possible to apply the recording section-side cables 68, 70, 72, and 74, the control section-side cables 102, 104, 106, and 108, the different-type cable 76 and the cable relay section 88 to another general liquid injection device.

Here, the liquid injection device is not limited to a recording apparatus, such as a printer, a multifunction printer and a facsimile, in which an ink jet type recording head is used, ink is discharged from the recording head, and recording is performed on the recording medium. The liquid injection device includes a device which injects liquid corresponding to the purpose of ink instead of ink, injects the liquid from a liquid injection head corresponding to the ink jet type recording head to an injected medium corresponding to the recording medium, and causes the liquid to adhere to the injected medium.

In addition to the recording head, a color material injection head, such as a liquid crystal display, which is used to manufacture a color filter, an electrode material (conductive pastes) injection head, such as an organic EL display or a Field Emission Display (FED), which is used to form electrodes, a bio organic matter injection head which is used to manufacture biochips, and a sample injection head as a precision pipette are provided as an example of the liquid injection head.

Also, the invention is not limited to the above embodiments, and various modifications are possible in the scope of the invention disclosed in claims, and it is apparent that the modifications are included in the scope of the invention.

The entire disclosure of Japanese Patent Application No. 2015-057202, filed Mar. 20, 2015 is expressly incorporated by reference herein.

What is claimed is:

1. A recording apparatus comprising:

a recording section that performs recording on a recording medium;

a cable relay section that is provided between a first area, in which the recording section is arranged, and a second area in which a control section for control is arranged, and that relays cables;

a first cable having a first end connected to the recording section and configured to extend from the recording section and having a second end connected to the cable relay section on a side of the first area; and a second cable having a first end connected to the control section and configured to extend from the control section and having a second end connected to the cable relay section on a side of the second area.

2. The recording apparatus according to claim 1, wherein the cable relay section is provided in a frame which performs division into the first area and the second area.

3. The recording apparatus according to claim 2, wherein an end of the cable relay section on the side of the first area is located on the side of the second area rather than an end of the frame on the side of the first area.

4. The recording apparatus according to claim 2, wherein the frame is provided with a cable passing section that causes the first area and the second area to communicate with each other and passes the cable, wherein a third cable, which has a signal standard different from those of the first cable and the second cable, directly connects the recording section to the control section through the cable passing section, and wherein the third cable is configured to be detachable from the recording section.

5. The recording apparatus according to claim 4, wherein the first cable and the third cable are arranged along an upper surface of the recording section and are configured to extend on an outside of the recording section, and wherein the first cable on an upper surface of the recording section is arranged on the upper side of the third cable.

6. The recording apparatus according to claim 5, further comprising:

a tube that supplies liquid from a liquid accommodation section, which accommodates the liquid, to the recording section, wherein the tube is arranged on an upper side of the first cable and is configured to extend to the outside of the recording section.

7. A recording apparatus comprising:

a detachable recording section that performs recording on a recording medium;

a tube relay section that is provided between a first area, in which the recording section is arranged, and a second area in which a control section for control is arranged, and that is configured to relay a tube;

a first tube that is provided on a side of the first area and having a first end that is connected to the tube relay section on the side of the first area and a second end configured to connect to the recording section; and a second tube that is provided on a side of the second area and having a first end that is connected to the tube relay section on the side of the second area and a second end configured to connect to the control section.

8. The recording apparatus according to claim 7, wherein the tube relay section is provided in a frame which performs division into the first area and the second area.

* * * * *